US012557874B2

(12) United States Patent
Narriman

(10) Patent No.: US 12,557,874 B2
(45) Date of Patent: Feb. 24, 2026

(54) ARTICLE OF FOOTWEAR HAVING A MODULAR PLATE SYSTEM

(71) Applicant: PUMA SE, Herzogenaurach (DE)

(72) Inventor: Neil Jafar Narriman, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 18/372,499

(22) Filed: Sep. 25, 2023

(65) Prior Publication Data

US 2024/0099422 A1 Mar. 28, 2024

Related U.S. Application Data

(60) Provisional application No. 63/409,950, filed on Sep. 26, 2022.

(51) Int. Cl.

| | |
|---|---|
| ***A43B 13/12*** | (2006.01) |
| ***A43B 3/34*** | (2022.01) |
| ***A43B 13/02*** | (2022.01) |

(52) U.S. Cl.

CPC ..... *A43B 13/125* (2013.01); *A43B 13/026* (2013.01); *A43B 3/34* (2022.01)

(58) Field of Classification Search

CPC ..... A43B 13/026; A43B 13/42; A43B 13/125; A43B 13/183; A43B 13/127; A43B 13/36; A43B 3/246; A43B 3/0031

See application file for complete search history.

(56) References Cited

U.S. PATENT DOCUMENTS

| | | | | |
|---|---|---|---|---|
| 5,187,883 | A * | 2/1993 | Penney | A43B 21/26 36/35 R |
| 7,984,569 | B2 * | 7/2011 | Chaney | A43B 13/24 36/15 |
| 8,544,189 | B2 * | 10/2013 | Chaney | A43B 13/24 36/15 |
| 10,681,955 | B2 * | 6/2020 | Beers | A43B 13/36 |
| 10,962,964 | B2 * | 3/2021 | Farren | G05B 19/4189 |
| 2015/0289591 | A1 * | 10/2015 | Jones | A43B 3/0047 36/25 R |
| 2018/0055143 | A1 * | 3/2018 | Baucom | A43B 13/183 |
| 2020/0113287 | A1 * | 4/2020 | Johnson | A43B 23/0225 |
| 2021/0052037 | A1 * | 2/2021 | Greenspan | A43B 13/223 |
| 2021/0227929 | A1 * | 7/2021 | Ni | A43B 13/37 |
| 2022/0039506 | A1 * | 2/2022 | Diard | A43B 13/143 |
| 2022/0061463 | A1 * | 3/2022 | Vanderoef | B29D 35/122 |
| 2022/0104584 | A1 * | 4/2022 | Bazan | A43B 3/244 |
| 2022/0304418 | A1 * | 9/2022 | Kaila | A43B 3/244 |
| 2023/0172313 | A1 * | 6/2023 | Dombrow | A43B 13/141 36/43 |

* cited by examiner

*Primary Examiner* — F Griffin Hall

(74) *Attorney, Agent, or Firm* — Quarles & Brady LLP

(57) ABSTRACT

An article of footwear that has an upper attached to a sole structure. The sole structure includes a midsole that is positioned between an insole and an outsole. The article of footwear also includes a plate that is removably received within a cavity formed within the midsole. The insole is configured to cover the plate within the cavity. The plate includes a reinforcing member that comprises carbon fiber.

14 Claims, 17 Drawing Sheets

ARTICLE OF FOOTWEAR HAVING A MODULAR PLATE SYSTEM

CROSS-REFERENCE TO RELATED APPLICATIONS

The present application claims priority to and the benefit of U.S. Provisional Application No. 63/409,950, filed on Sep. 26, 2022, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear having a modular plate system, more specifically, an article of footwear having a plate that can be removed and replaced with another plate.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of the shoe tightness. The tongue may further be manipulable by a user to permit entry or exit of a foot from the internal space or cavity. In addition, the lacing system may allow a user to adjust certain dimensions of the upper or sole, thereby allowing the upper to accommodate a wide variety of foot types having varying sizes and shapes.

The sole may comprise a wide variety of materials, which may be chosen based on one or more intended uses of the shoe. The sole may also include portions comprising varying materials specific to a particular area of the upper. For example, added stability may be desirable at a front of the sole or adjacent a heel region so as to provide a higher degree of resistance or rigidity. In contrast, other portions of a shoe may be soft to provide an area with flexibility, cushioning, and conformity to a user's foot. Further, wearers who suffer from pes planus (a.k.a. flat feet), or other particularities, often add inserts to their shoes to provide more targeted support. This wide variety of user preferences leads to a desire for a shoe that can be customized to provide cushioning, support, and rigidity along different areas, orientations, and zones of the shoe.

However, while many currently-available shoes have varying features related to the above-noted properties, many shoes have sole structures with one or more plates that cannot be removed therefrom. Therefore, once the plates have worn down or the elasticity of the plates have diminished, a user would need to get an entirely new shoe in order to improve the plates therein.

Therefore, articles of footwear having a modular plate system are desired. These and other deficiencies with the prior art are outlined in the following disclosure.

SUMMARY

A number of advantages of the articles of footwear described herein will be apparent to those having ordinary skill in the art. An article of footwear, as described herein, may have various configurations. The article of footwear may have an upper and a sole structure connected to the upper.

In some aspects, an article of footwear comprises an upper attached to a sole structure. The sole structure includes a midsole that is positioned between an insole and an outsole. The article of footwear also comprises a plate that is removably received within a cavity formed within the midsole. The insole is configured to cover the plate within the cavity. The plate includes a reinforcing member that comprises carbon fiber.

In some embodiments, the midsole further comprises a slot that is in communication with the cavity. In some embodiments, the slot is positioned in a heel region of the article of footwear. In some embodiments, the slot is positioned in a forefoot region of the article of footwear. In some embodiments, the cavity comprises a cavity wall, and a plurality of fingers extend from the cavity wall and into the cavity. In some embodiments, the plurality of fingers are configured to engage a portion of the plate disposed within the cavity.

In some aspects, an article of footwear comprises an upper attached to a sole structure and a plate that extends from a heel region to a forefoot region of the article of footwear. The sole structure includes an opening formed between the upper and the sole structure. The plate is configured to be removably received within a cavity formed within the sole structure. An insole is configured to cover the plate within the cavity. A slot is in communication with the cavity and configured for insertion and removal of the plate therethrough.

In some embodiments, the slot extends within the heel region of the article of footwear. In some embodiments, the slot extends along a lateral side or a medial side of the article of footwear. In some embodiments, the article of footwear further comprises a flap. In some embodiments, the flap comprises a notch on an interior surface of the flap. In some embodiments, the flap is configured to receive a portion of the plate within the notch in a closed state. In some embodiments, the flap is integral with the sole structure.

In still another aspect, a system for an article of footwear comprises an upper attached to a sole structure, a first plate that has a first indicator and a first stiffness value, and a second plate that has a second indicator and a second stiffness value. A cavity is formed within the sole structure and positioned between an insole and an outsole of the article of footwear. The first indicator is configured to indicate the first stiffness value. The second indicator is configured to indicate the second stiffness value. The first plate and the second plate are configured to be interchangeably received within the cavity of the article of footwear.

In some embodiments, the first plate and the second plate are configured to be interchangeably received within the cavity of the article of footwear via a slot, and the slot is positioned in a heel region of the article of footwear. In some embodiments, the first indicator or the second indicator indicates a depleted condition. In some embodiments, the article of footwear comprises one or more markings that are machine-readable identifiers. In some embodiments, the one or more markings connect a user to a digital platform when scanned by a user device. In some embodiments, the first indicator or the second indicator is a machine-readable identifier. In some embodiments, the first indicator or the second indicator connect a user to a digital platform when scanned by a user device.

In yet another aspect, a method of using a modular plate system comprises providing an article of footwear that has an upper attached to a sole structure. A cavity is formed within the sole structure of the article of footwear and positioned between an insole and an outsole of the article of footwear. The method also comprises providing a first plate that has a first indicator and providing a second plate that has a second indicator. The method further comprises positioning the first plate within the cavity of the article of footwear and cycling the first plate until the first indicator indicates a depleted condition. The method also comprises replacing the first plate with the second plate within the cavity of the article of footwear.

In some embodiments, the method of using the modular plate system further comprises cycling the second plate until the second indicator indicates a depleted condition and replacing the first plate with a third plate within the cavity of the article of footwear. In some embodiments, the first indicator or the second indicator is a machine-readable identifier.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
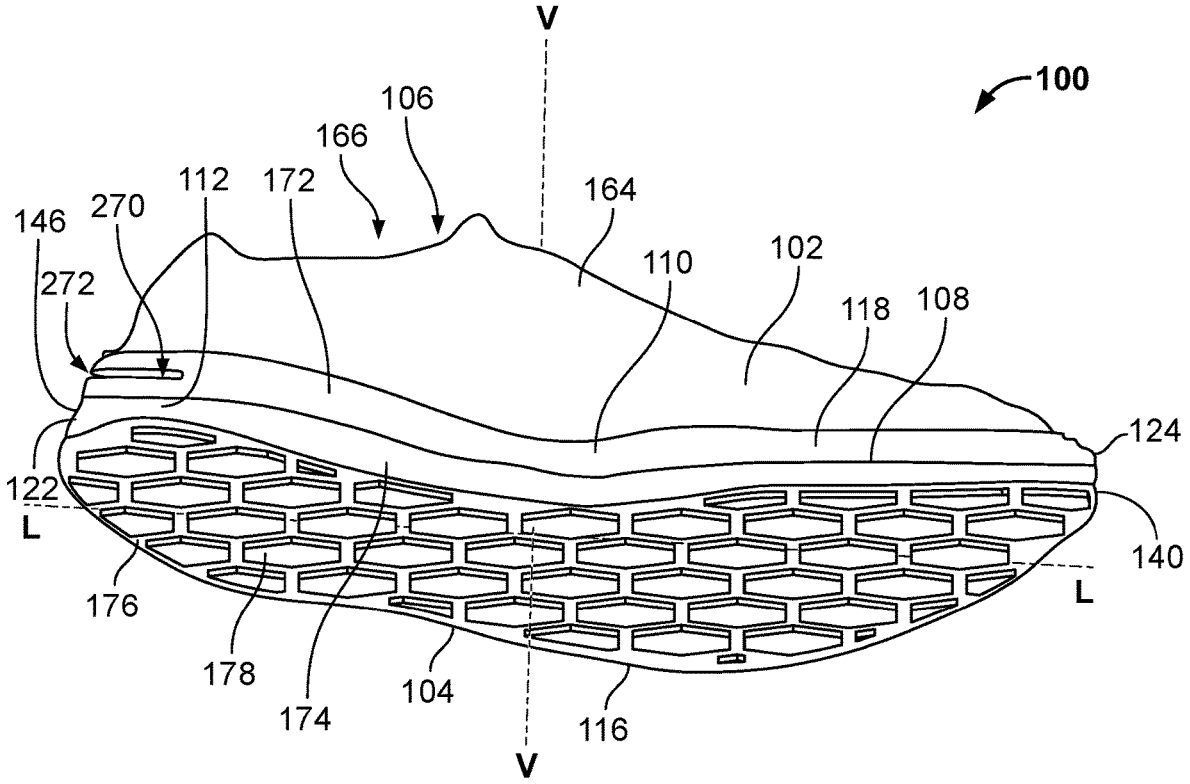
FIG. 1 is a perspective view of a bottom and medial side of an article of footwear configured as a left shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes. As noted herein, all ranges disclosed within this application are inclusive of the outer bounds of the range.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
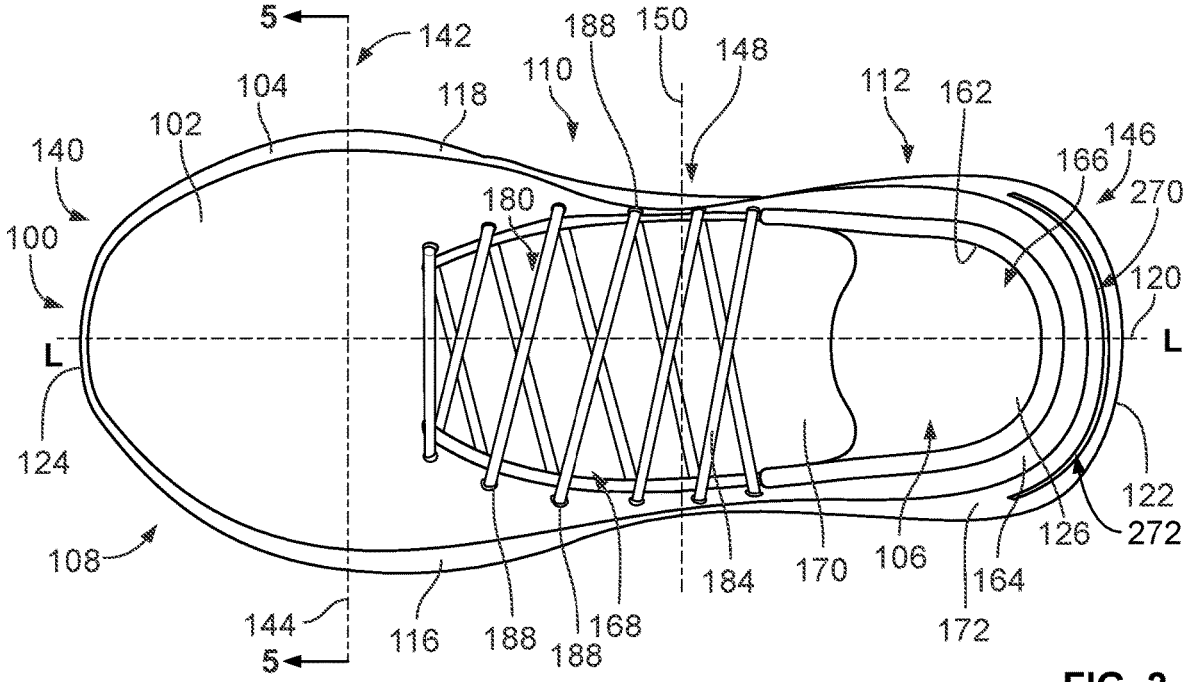
FIG. 2 is a top view showing the article of footwear of FIG. 1.
Figure 3:
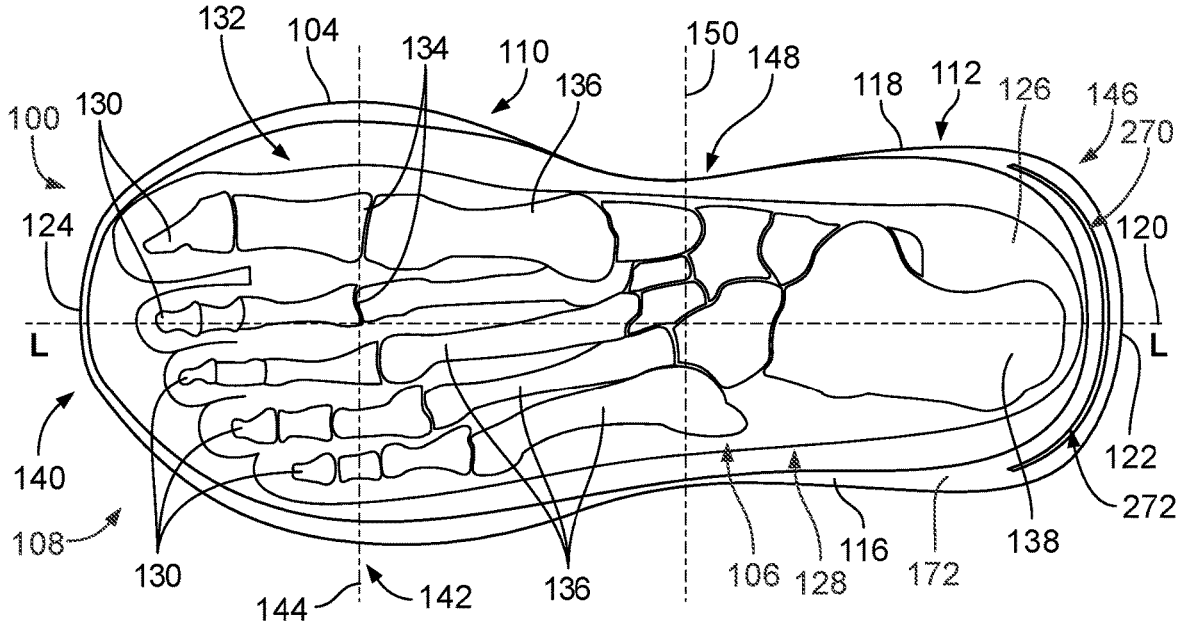
FIG. 3 is a top plan view of the article of footwear of FIG. 1, with an upper removed and a user's skeletal foot structure overlaid thereon.

FIGS. 1-3 depict an exemplary embodiment of an article of footwear 100 configured as a shoe including an upper 102 and a sole structure 104. The upper 102 is attached to the sole structure 104 and together define an interior cavity 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon. For reference purposes, a vertical axis V is illustrated in FIG. 1 as being disposed centrally of the footwear 100 and generally normal or orthogonal to a longitudinal axis L. The vertical axis V extends through the midfoot region 110 of the footwear 100 and, further, defines a vertical plane that is disposed between the forefoot region 108 and the heel region 112. The longitudinal axis L extends through the sole 104 of the footwear 100 and within the forefoot region 108, the midfoot region 110, and the heel region 112. The longitudinal axis L defines a longitudinal plane that is generally normal to the vertical plane of the vertical axis V, and the longitudinal plane L may be disposed tangential to or coplanar with a portion of the sole 104.

While only a single shoe 100 is depicted, i.e., a shoe that is worn on a left foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, however, a single shoe will be referenced to describe aspects of the disclosure, but the disclosure below with reference to the article of footwear 100 is applicable to both a left shoe and a right shoe. However, in some embodiments there may be differences between a left shoe and a right shoe other than the left/right configuration. Further, in some embodiments, a left shoe may include one or more additional elements that a right shoe does not include, or vice versa.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, waterproofing, or scuff-resistance, may be varied. In some embodiments, the upper 102 is comprised of various layers that are heat pressed together to bond the various layers of the upper 102. For example, layers that comprise the upper 102 can be heat pressed together all at once and at a single temperature. The materials that comprise the upper 102 may include an inner mesh layer, a thermoplastic polyurethane (TPU) film, and an outer mesh layer. In some embodiments, a TPU skin may be applied along the outer surface of the upper.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board that is attached to the upper by strobel stitching, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

Referring to FIG. 1, the sole structure 104 includes a midsole 172 and an outsole 174. In some instances, the outsole 174 may be defined as a portion of the sole 104 that at least partially contacts an exterior surface, e.g., the ground, when the article of footwear 100 is worn. The outsole 174 may define a bottom end or bottom surface 176 of the sole structure 104 across the heel region 112, the midfoot region 110, and the forefoot region 108. Further, the outsole 174 may include a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be defined as at least a portion of the sole 104 that extends from the outsole 174 toward the upper 102 or that otherwise extends between and connects the outsole 174 with the upper 102. The midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Turning back to FIG. 2, the article of footwear 100 also includes a tightening system 180 that includes a lace 184 and a plurality of eyelets 188. In this embodiment, the lace 184 extends through the plurality of eyelets 188. In some embodiments, the tightening system 180 may include elastic bands. The tightening system 180 may allow a user to modify dimensions of the upper 102, e.g., to tighten or loosen portions of the upper 102 and/or sole 104, around a foot as desired by the wearer. The tightening system 180 may also include a band (not shown) that runs along a center of the upper 102 and includes one or more loops through which the lace 184 may be guided. In other embodiments, the tightening system 180 may be a hook-and-loop fastening system, such as Velcro®. For example, in some embodiments, the tightening system 180 may include one or more hook-and-loop fastening straps. In further embodiments, the tightening system 180 may be another laceless fastening system known in the art. In still further embodiments, the tightening system 180 may include a different manual lacing system, a rotary closure device, or an automatic lacing system, such as the lacing systems described in U.S. patent application Ser. No. 15/780,368, filed on May 31, 2018 and U.S. patent application Ser. No. 16/392,470, filed on Apr. 23, 2019, both of which are hereby incorporated by reference in their entirety.

The present disclosure provides a removable plate that may be manufactured using an additive manufacturing process (e.g., printed layer by layer). The additive manufacturing process incorporates user metrics gathered from various sources (e.g., pressure heat map information, laser scanners, force plates, user preferences, and the like) and continuous fiber fabrication (CFF) manufacturing techniques to optimize the plate to a particular user's performance preferences for propulsion, stability, and comfort, among other preferences. Additive manufacturing enables the plate to be manufactured with minimized waste as compared with traditional, subtractive manufacturing process (e.g., injection molding, milling, grinding, and the like). Further, additive manufacturing enables the plate to be manufactured with reduced steps and iterations, avoiding excessive labor that would typically be required for customized, unique designs optimized for particular user preferences. In addition, the CFF manufacturing techniques enable the plate to be manufactured efficiently and affordably while using expensive, high-performance materials, such as, e.g., carbon fiber, glass fiber, and Kevlar®, among others. Because additive manufacturing involves the addition of material in an iterative process to construct the plate as designed, waste of material and time is minimized. This is particularly important when considering costs associated with expensive materials like carbon fiber and Kevlar®, and also when considering the availability of supplies and/or shipping of such materials on an as-needed basis. By reducing waste, users can source materials in more accurate quantities and with greater predictability, while also saving on shipping costs and resulting emissions and/or pollution associated with the shipping and transport of expensive materials over long distances, e.g., globally. In some embodiments, the manufacturing methods of the plate may be similar to the manufacturing methods disclosed in U.S. patent application Ser. No. 17/578,752, filed on Jan. 19, 2022, which is incorporated herein by reference in its entirety. In some embodiments, the plate may be created using conventional manufacturing methods, i.e., additive manufacturing methods are not used.

Additive manufacturing using CFF is preferred for manufacturing a plate according to the present disclosure. The additive manufacturing process may be carried out using a 3D printer, such as printers manufactured by MarkForged®, which is capable of receiving a design model and generating printing instructions to 3D print the plate. A design model may be an electronic three-dimensional representation of a plate that is intended to be formed for an article of footwear. In some embodiments, the design model may be in the form of a 3DCAD file, or a 3D stereolithographic file (.STL file), or any file compatible with a web-based or cloud-based design program, such as Eiger™ offered by MarkForged®.

Alternatively or additionally, the design model may be generated by the controller in response to input data. For example, as further discussed below, the physical characteristics that are gathered and entered into the software and used to design and generate a design model may include an end users weight, an end users gait, and/or an end users foot pressure map measured during standing, walking, cutting movements, and/or running. Additionally, various measurements of the foot may be recorded to determine suitable dimensions of the plate, and other aspects of the footwear, as well as data associated with the gait of the foot may be obtained to determine if the foot orientation is indicative of toe striking or heel striking, among other scenarios. The foot measurements and data may be used to determine optimal geometries and performance properties of the plate, as well as the optimal position of the plate within the footwear. Moreover, measurements and data collected may be used for the selection of materials comprising the plate. Further, the additive manufacturing processes described herein allow for tailoring of the stiffness of the plate for a particular wearer based on the measurements and data collected. For example, the tendon stiffness and calf muscle strength of a user can be measured to determine a suitable stiffness of the plate for use by the wearer. Further, the stiffness of the plate can be tuned based on biomechanics and running mechanics of a particular user, such as how the angles of the wearer's joints change during movements, such as through dorsiflexion and plantarflexion. In some examples, force and motion measurements of the wearer are obtained before manufacturing a custom plate for the user. In other examples, plates are manufactured in increments of stiffness to provide semi-custom footwear such that the individual wearers may select a suitable stiffness.

Various alternative methods of additive manufacturing methods that can be used to manufacture a plate for an article of footwear according to the present disclosure may include binder jetting, direct energy deposition, selective laser melting (SLM), fused deposition modeling (FDM), electron beam melting, laser powered bed fusion (LPBF), ultrasonic additive manufacturing, material extrusion, material jetting, Joule printing, electrochemical deposition, cold spray metal printing, DLP metal printing, Ultrasonic Consolidation or Ultrasonic Additive Manufacturing (UAM), LENS laser-based printing, vat photopolymerization, sheet lamination, or electron beam freeform fabrication (EBF3).

As used herein, the term "stiffness" refers to the way in which a component resists deformation when a load is applied. In particular, "stiffness" will be discussed herein with respect to elastic deformation, i.e., temporary deformation that is considered non-destructive. Therefore, "stiffness" may be used in harmony with the terms "resistance" and "strength." Further, "stiffness" may be described herein with respect to various directions, types of deformation, material properties, and the like. For example, the "stiffness" of a component may be broken down into flexural stiffness, tensile stiffness, or shear stiffness. Further, the "stiffness" of a component is correlated to the modulus of elasticity (E) of the materials used, where modulus of elasticity can be quantified by the Young's modulus formula $E=\sigma/\varepsilon$, where $\sigma$ is uniaxial stress, i.e., force per unit surface, and $\varepsilon$ is strain, i.e., proportion deformation. For purposes of clarity, "stiffness" may be further specified herein to refer to particular types of resistance, such as bending resistance BR and torsional resistance TR. In some instances, the "stiffness" of a component may be quantified or calculated with respect to a dimension, a mass, or a volume. For example, the "stiffness" of a component may be measured in units of Newtons per millimeter (N/mm), or in units of gigapascals (GPa), although other units may be used. Further, "stiffness" may be referenced qualitatively as being high or low, while also being understood in relation to various aspects of footwear, such as comfort, support, stability, rigidity, and durability, among others.

Figure 4:
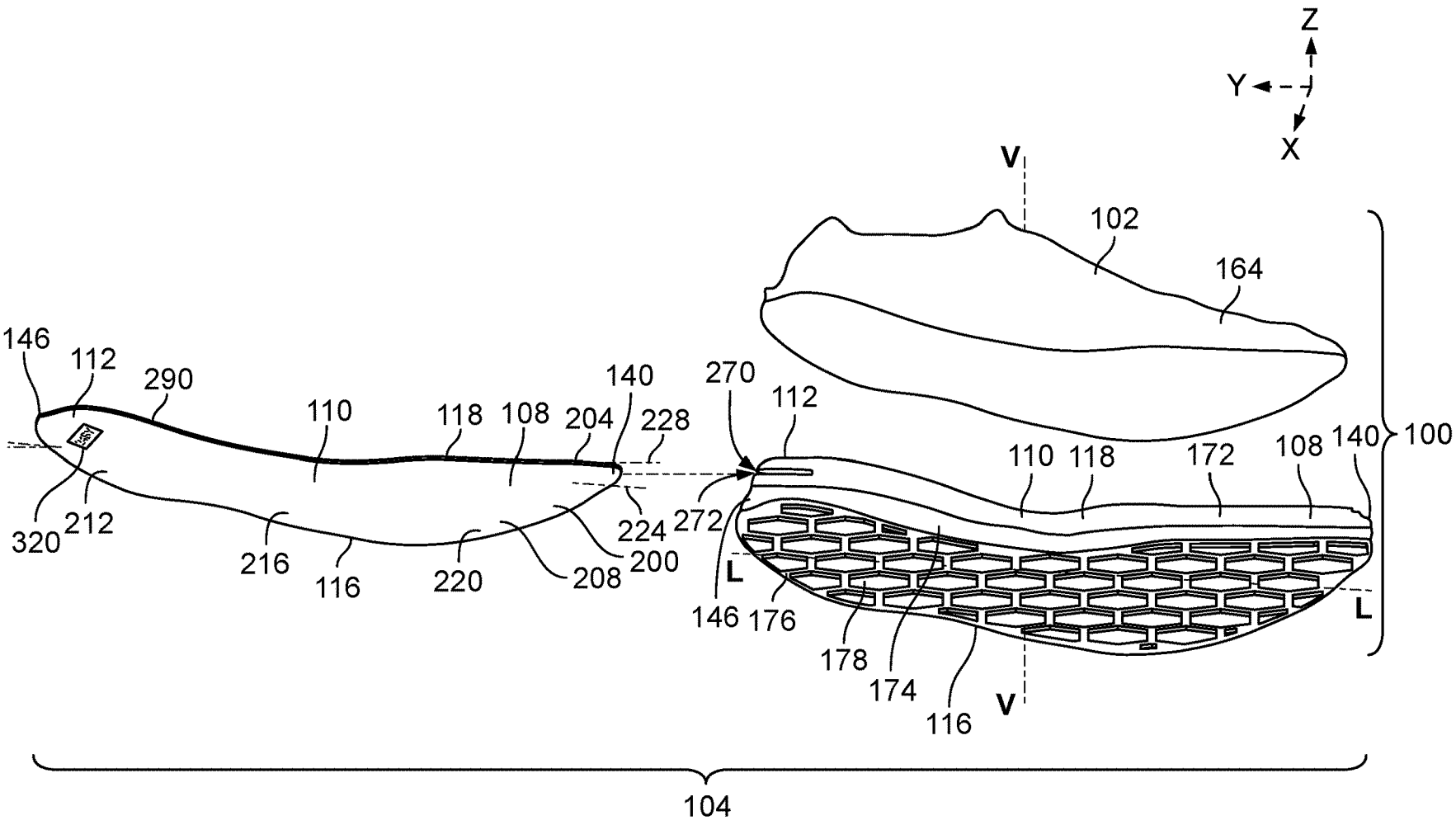
FIG. 4 is an exploded view of the article of footwear of FIG. 1 showing a plate according to an embodiment of the present disclosure.

FIG. 4 depicts an exploded view of the article of footwear 100 including a plate 200, according to an embodiment of the present disclosure. The plate 200 includes a top side 204 that is opposite a bottom side 208 and a posterior segment 212, an arch segment 216, and an anterior segment 220. The posterior segment 212 may extend through at least the heel region 112 of the footwear 100 when incorporated therein and may correspond with portions of the plate 200 positioned near rear portions of a foot, as previously discussed herein. The arch segment 216 of the plate 200 is proximate to and adjoins the posterior segment 212, and corresponds with portions of the plate 200 positioned near the midfoot region 110 of the footwear 100 that encase the arch of the foot, along with the bridge of the foot. The anterior segment 220 of the plate 200 is proximate to and adjoins the arch segment 216, and corresponds with portions of the plate 200 positioned near the forefoot region 108 of the footwear 100 that encase the toes, the ball of the foot, and joints connecting the metatarsals with the toes or phalanges. The plate 200 defines a longitudinal reference axis 224 that intersects the plate 200 at the heel end 146 and the toe end 140. Also, the plate 200 defines a centerline axis 228 that bisects the heel end 146 and the toe end 140, such that the reference axis 224 extends at an angle relative to the centerline axis 228.

In the illustrated embodiment, the plate 200 is configured to be removably attached to the midsole 172 of the article of footwear 100. Put differently, the plate 200 is capable of being inserted and removed from a cavity 270 within the midsole 172 via a slot 272. As illustrated in FIG. 4, the cavity 270 is positioned entirely within the midsole 172, and the slot 272 is positioned in the heel region 112 of the article of footwear 100 and adjacent to or on the heel end 146. In some embodiments, the slot 272 may be positioned on a different portion of the article of footwear 100, i.e., the lateral side 116, the medial side 118, or toe end 140. Therefore, it is contemplated that the plate 200 may be removably attached to the midsole 172 at any position.

Referring still to FIG. 4, the cavity 270 is sized and shaped to receive the plate 200 therein. Therefore, a user can slide the plate 200 through the slot 272 and into the cavity 270. In some embodiments, the cavity 270 may comprise a size and shape that is substantially the same as the plate 200. Further, in some embodiments, the cavity 270 may comprise a size and shape that is different from the plate 200. For example, in some embodiments, the cavity 270 may be deformable and the size of the cavity 270 may be slightly smaller than the plate 200. Therefore, as the user inserts the plate 200 into the cavity 270, the cavity 270 will expand and securely retain the plate 200 therein, i.e., the midsole 172 will hold the plate 200 therein.

Referring still to FIG. 4, the plate 200 can be securely retained within the cavity 270 of the midsole 172. In some embodiments, the plate 200 may be securely retained within the cavity 270 via a friction fit or by engageable parts, i.e., the plate 200 is in contact with the midsole 172. Further, in some embodiments, the plate 200 may be fastened to the midsole 172 via various fastening mechanisms, such as fasteners, cables, clamps, slidable fastening systems, or hooks. Furthermore, in some embodiments, the plate 200 may be fastened within the cavity 270 via Velcro®, magnetic elements, or interlocking parts. Therefore, it is contemplated that the plate 200 can be removably secured within the cavity 270 in any conventional way known to one of ordinary skill in the art.

Referring still to FIG. 4, the plate 200 is configured to be removably embedded within the midsole 172, as indicated by the dashed explode line indicating a path along which the plate 200 can be inserted. However, in some embodiments, the plate 200 may be fitted between the midsole 172 and the upper 102, or between the midsole 172 and the outsole 174, or the plate 200 may be configured as the outsole 174 that is attached to the upper 102, or the plate 200 may be included as part of the upper 102.

As discussed above, the plate 200 is configured to be removably attached to the midsole 172. Therefore, as will be discussed in greater details herein, once the plate 200 has been used over time, a user can remove the plate 200 from the article of footwear 100 and replace it with a different or new plate 200. Thus, instead of having to buy an entirely new shoe, a user can simply remove the plate 200 and replace it with a new plate 200. In some embodiments, the new plate 200 may be smaller than or comprise different dimensions than the original plate 200. Further, in some embodiments, the new plate 200 may comprise different materials or strength properties than the original plate 200. Therefore, it is noted that the plate 200 may comprise various sizes and shapes and still be capable of being secured within the cavity 270 of the midsole 172. Further, in some embodiments, multiple plates 200 may be used to give the user different performance characteristics. For example, if the user is preparing to run a long distance race, it may be beneficial for the user to have a stiffened article of footwear 100. Therefore, the user may insert a plate 200 with higher stiffness to train for the race and then may swap out that plate 200 with one of lower stiffness before running the race. Alternatively, the user may insert the plate 200 with higher stiffness before running the race and, after the race, the user can then switch out the plate 200 for a plate 200 with less stiffness. Thus, the plate 200 in the article of footwear 100 can be replaced with various other plates 200 to customize the needs of the user.

For purposes of clarity, directional coordinates X, Y, and Z will be referenced in this disclosure. In particular, the X direction corresponds to the lateral-to-medial direction that is orthogonal to a longitudinal direction in which the longitudinal reference axis 224 extends, the Y direction corresponds to the longitudinal direction that is parallel with the longitudinal reference axis 224, and the Z direction corresponds to a vertical direction that is orthogonal to the X and Y directions. Further, the term "in-plane" will be used herein to refer to a 2-dimensional plane that extends in the X direction and the Y direction, to which the Z direction is orthogonal. Additionally, it will be understood that the longitudinal reference axis 224 also defines a longitudinal reference plane extending vertically in the Z direction. With reference to FIGS. 1 and 4, it will be appreciated that the longitudinal plane defined by the longitudinal axis L may be coplanar with the in-plane directions or portions of the footwear 100. Further, the vertical plane defined by the vertical axis V may extend in the Z direction and be generally normal to the in-plane directions and the longitudinal plane.

Figure 6:
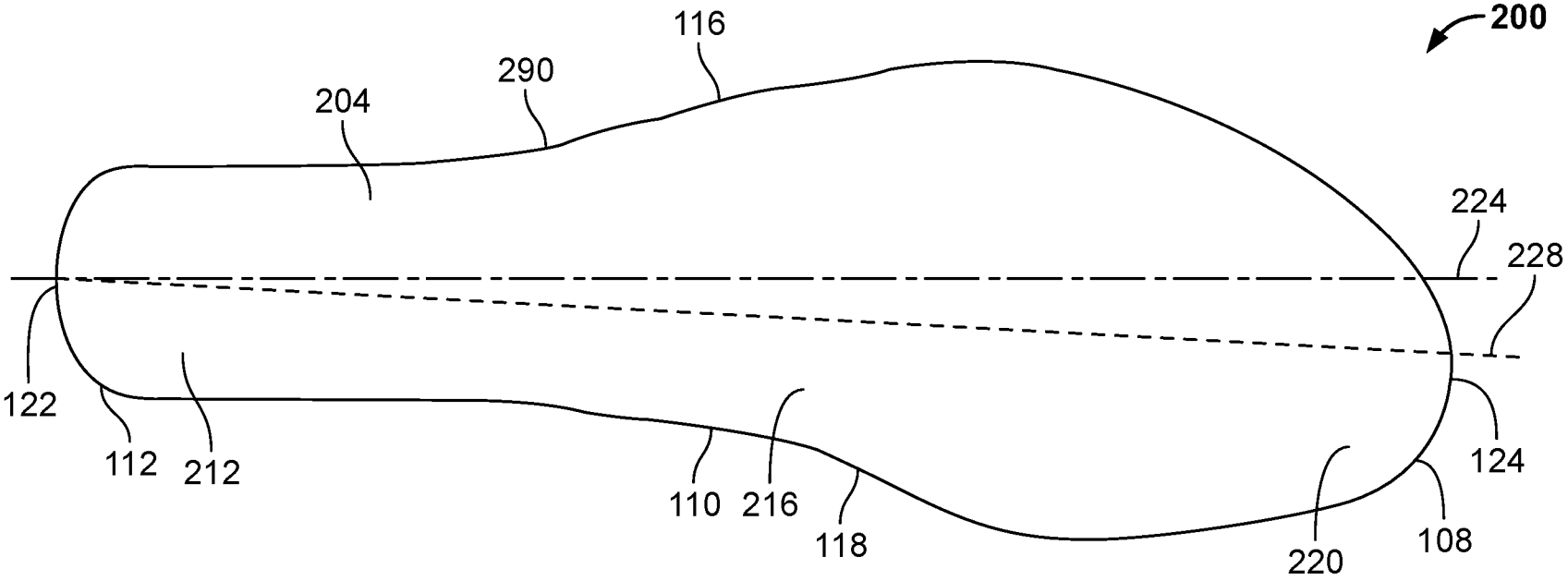
FIG. 6 is a top plan view of the plate of FIG. 4.

Referring to FIGS. 4 and 6, the plate 200 defines a periphery 290 that curves outwardly relative to the centerline axis 228 from the heel end 146 toward the lateral side 116 within the heel region 112 to at least partially define the posterior segment 212. The periphery 290 extends farther along the lateral side 116 toward the midfoot region 110 and curves outwardly relative to the centerline axis 228 to at least partially define the arch segment 216. Additionally, the periphery 290 extends within the forefoot region 108 and curves outwardly before curving inwardly toward the toe end 140 to at least partially define the anterior segment 220. Similarly, the periphery 290 curves outwardly from the heel end 146 toward the medial side 118 within the heel region 112 to at least partially define the posterior segment 212. The periphery 290 extends farther along the medial side 118 toward the midfoot region 110 and curves outwardly to at least partially define the arch segment 216. Additionally, the periphery 290 extends within the forefoot region 108 and curves outwardly before curving inwardly toward the toe end 140 to at least partially define the anterior segment 220. Accordingly, the periphery 290 extends continuously across the entire plate 200 from the posterior segment 212 to the anterior segment 220 and vice versa and from the lateral side 116 to the medial side 118 and vice versa. In some embodiments, a plurality of latching elements, e.g., protrusions, apertures, etc. may extend from or be positioned on portions of the periphery 290 in order to fasten with the midsole 172. For example, the periphery 290 of the plate 200 may comprise a protrusion or male member that interacts with a notch or female member in the midsole 172 to securely retain the plate 200 within the midsole 172.

Figure 5:
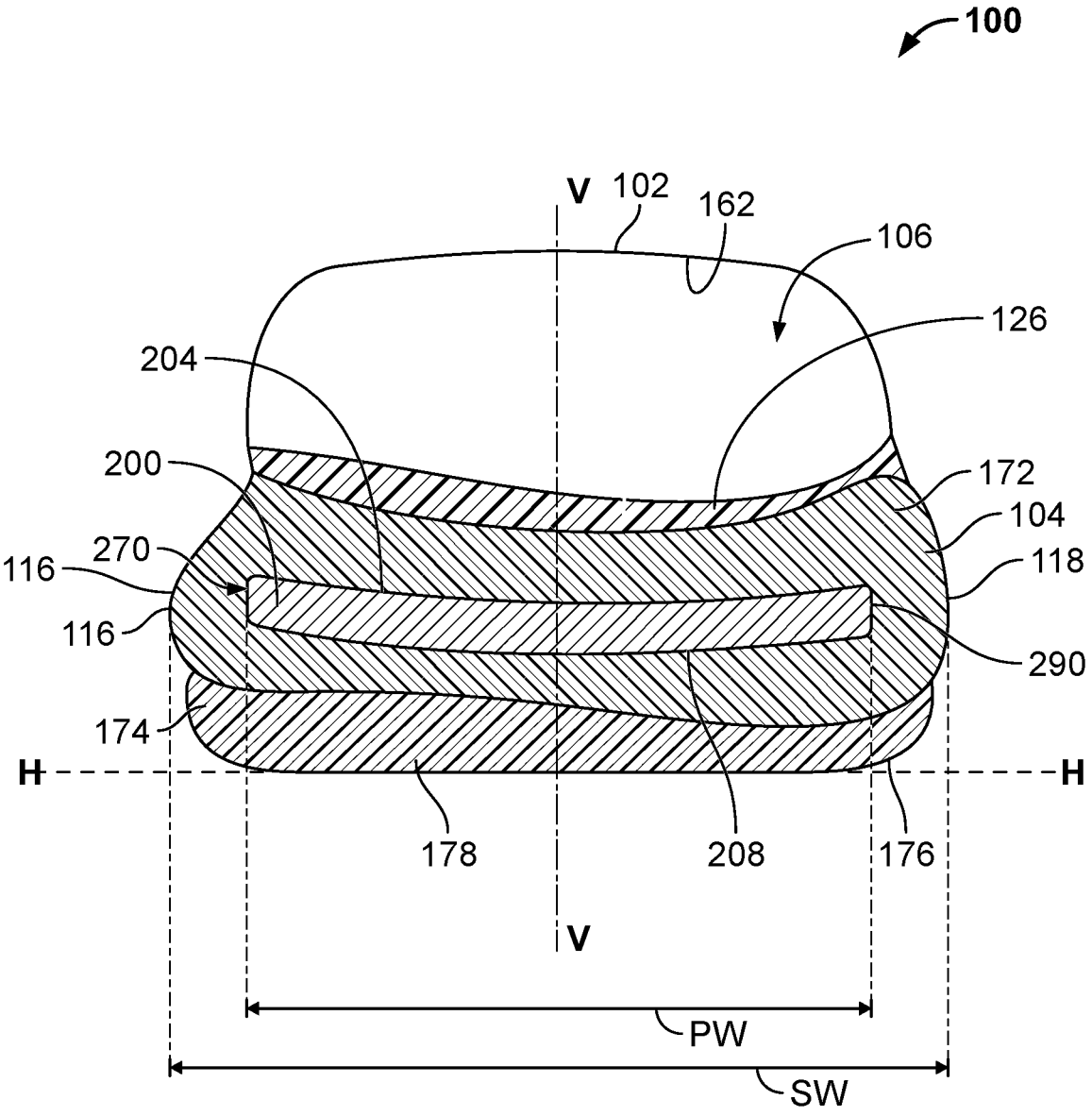
FIG. 5 is a section view of the article of footwear taken along the line 5-5 in FIG. 2.

In the illustrated embodiment of FIG. 5, the plate 200 is embedded within the sole 104 of the article of footwear 100 and, more specifically, the plate 200 is embedded within the midsole 172 of the sole 104. Further, the upper 102 includes the insole 126 in a strobel arrangement such that the insole 126 is spaced apart from and does not directly contact the plate 200. In other words, the insole 126 is configured to cover the plate 200 within the cavity 270, i.e., the plate 200 cannot be seen through the opening 166 of the upper 102. In some embodiments, the plate 200 can be embedded within the midsole 172 in a manner allowing for portions of the plate 200 to be in contact with the insole 126 or upper 102. Further, in some embodiments, portions of the plate 200 may be in contact with the outsole 174. In other embodiments, the plate 200 may be provided as part of the upper 102. For example, the plate 200 may be included as part of the insole 126 or inserted within the cavity 106 of the footwear 100 similar to conventional orthotic inserts. In some embodiments, the plate 200 may comprise the entire sole structure 104 of the footwear 100, such that the footwear 100 includes only the upper 102 and the plate 200. In the illustrated embodiment, the vertical plane V is disposed centrally between the lateral side 116 and the medial side 118 of the plate 200, and a horizontal plane H is disposed normal to the vertical plane V and tangential to or coplanar with a portion of the bottom side 208 of the plate 200. In this particular instance, the plate 200 has a geometry in which the top side 204 of the plate 200 is curved relative to the horizontal plane H between the medial side 118 and the lateral side 116. Further, the bottom side 208 defines a varying curvature relative to the horizontal plane H between the lateral side 116 and the medial side 118. Also, the periphery 290 of the plate 200 is straight, i.e., substantially parallel to the vertical plane V, along the lateral side 116 and the medial side 118. In some embodiments, the periphery 290 of the plate 200 may be curved, arched, or angled.

Referring still to FIG. 5, the plate 200 is generally curved between the medial side 118 and the lateral side 116 and also curved relative to surrounding components of the footwear 100. For example, the plate 200 curves downwardly toward the horizontal plane H between the lateral side 116 and the vertical plane V and then curves upwardly away from the horizontal plane H between the vertical plane V and the medial side 118, such that the plate 200 is convexly curved relative to the horizontal plane H. Because the horizontal plane H is tangential to the outsole 174 in FIG. 5, the plate 200 is also convexly curved relative to the outsole 174. However, the plate 200 is concavely curved relative to the upper 102, such that the plate 200 curves farthest away from the upper 102 near the vertical plane V and curves nearest to the upper 102 at the medial side 118 and the lateral side 116. In some embodiments, the plate 200 may curve in the opposite direction than shown, i.e., comprise a concave curve relative to the outsole 174. Further, in some embodiments, the plate 200 may be substantially flat, i.e., parallel or substantially parallel with the horizontal plate H. Furthermore, the insole 126 and the plate 200 are depicted as having generally similar curvatures in the article of footwear 100 of FIG. 5, although other configurations are possible. Moreover, the midsole 172 at least partially surrounds the plate 200 and defines varying curvatures above and below the plate 200 that, as illustrated, differ from the curvature of the plate 200. In the illustrated embodiment, the insole 126, the midsole 172, the plate 200, and the outsole 174 are all mated together to conform to the curvatures of one another, such that no voids or gaps are disposed therebetween (besides for the cavity 270 once the plate 200 is removed). However, it will be appreciated that voids or gaps may be formed between one of the insole 126, the midsole 172, the plate 200, and the outsole 174, such that the curvatures of insole 126 do not conform to the curvatures of the midsole 172, and so on.

Referring still to FIG. 5, the plate 200 is positioned generally in the middle of the midsole 172, and the plate 200 does not extend the entire width, i.e., measured parallel to the horizontal plane H, of the sole structure 104. As illustrated in FIG. 5, the plate 200 comprises a plate width PW and the sole structure 104 comprises a sole width SW. In preferred embodiments, the plate width PW is smaller than the sole width SW along the entirety of the plate 200 and sole structure 104. However, in some embodiments, the plate width PW may be equal to or greater than the sole width SW (see FIG. 8). Therefore, in some embodiments, the plate 200 may be seen on the lateral side 116 and/or medial side 118 of the sole structure 104 from an exterior of the article of footwear 100 (see FIG. 8). However, as illustrated in FIG. 5, the plate 200 is encased within the midsole 172, i.e., the plate 200 is entirely surrounded by the midsole 172 except for the slot 272. As noted herein and as illustrated in FIGS. 5 and 6, the plate width PW changes depending on the portion of the plate 200, i.e., the posterior segment 212 of the plate 200 has a thinner plate width PW than the arch segment 216 of the plate 200. Therefore, in some embodiments, the widest portion of the plate 200, i.e., measured parallel to the horizontal plane H in FIG. 5, is smaller than the narrowest portion of the cavity 270, i.e., measured parallel to the horizontal plane H in FIG. 5 similar to the plate width PW. This way, the plate 200 can slide fully into the cavity 270 without getting stuck.

As discussed above, the midsole 172 may be deformable adjacent the cavity 270. Therefore, in some embodiments, the width of the cavity, i.e., measured parallel to the horizontal plane H in FIG. 5, may be smaller than a portion of the plate 200. For example, the width of the cavity 270 in the heel region 112 may be smaller than the width of the cavity 270 in the forefoot region 108. Thus, in order for the user to insert the plate 200 within the cavity, the user will need to apply additional force to the plate 200 during installation in order for the arch segment 216 of the plate 200, i.e., widest portion of the plate 200, to get through this narrower region in the heel region 112 of the cavity 270. As additional force is applied, the midsole 172 around the heel region 112 can deform to allow the arch segment 216 of the plate 200 through. Once the arch segment 216 of the plate 200 is through, the heel region 112 of the midsole 172 can snap back to its original configuration to secure the posterior segment 212 of the plate 200. This deformation can assist in securing the plate 200 within the cavity 270 and allow the plate 200 to not slide out during use.

In some embodiments, the plate width PW is between about 5% and about 105% of the sole width SW. In some embodiments, the plate width PW is between about 50% and about 90% of the sole width SW. In some embodiments, the plate width PW is between about 60% and about 85% of the sole width SW. In some embodiments, the plate width PW is less than about 100% of the sole width SW, or less than about 90% of the sole width SW, or less than about 80% of the sole width SW, or less than about 70% of the sole width SW, or less than about 60% of the sole width SW, or less than about 50% of the sole width SW.

Referring to FIG. 6, a top plan view of the plate 200 is illustrated. As illustrated in FIG. 6, the plate 200 comprises a general shape that corresponds to the shape of a user's foot. However, as will be discussed in greater detail herein, the plate 200 can comprise various shapes and configurations. Referring now to FIGS. 4 and 6, in order to insert the plate 200 into the midsole 172, the user can grab or pinch the posterior segment 212 of the plate 200 and position the anterior segment 220 of the plate 200 to be aligned with the slot 272 of the midsole 172 (see FIG. 4). Once the anterior segment 220 is aligned with the slot 272, the user can apply a force onto the plate 200 and urge the plate 200 into the slot 272. The plate 200 will continue to slide into the slot 272 and into the cavity 270 until the anterior segment 220 of the plate 200 makes contact with an end wall (not shown) of the cavity 270. Once the plate 200 makes contact with the end wall, the plate 200 is fully secured within the cavity 270 of the midsole 172. As discussed above, in some embodiments, the plate 200 may be fastened to the midsole 172 by way of various engaging parts.

In some embodiments, the plate 200 may be inserted into the midsole 172 from the top of the article of footwear 100. In particular, in some embodiments, the insole 126 may be removably attached to the sole structure 104, and the plate 200 may be dropped in or inserted into the cavity 270 once the insole 126 has been removed. Therefore, the cavity 270 can be exposed once the insole 126 has been removed from the sole structure 104. Once the plate 200 has been secured within the midsole 172, the insole 126 can be reattached to the sole structure 104, thereby securing the plate 200 within the midsole 172. In such an embodiment, the sole structure 104 may not include the slot 272 on an exterior of the midsole 172, i.e., the cavity 270 would be completely enclosed once the insole 126 was attached to the sole structure 104.

Further, in some embodiments, the plate 200 may have a smaller longitudinal length, i.e., length parallel to the longitudinal axis L, than shown. For example, in some embodiments, the plate 200 may not have a longitudinal length that is similar to a longitudinal length of the sole structure 104, i.e., a length parallel to the longitudinal axis L. Instead, in some embodiments, the plate 200 may have a longitudinal length that is less than the longitudinal length of the sole structure 104. Therefore, in some embodiments, the posterior segment 212 of the plate 200 may not be positioned near the slot 272 and/or the periphery 290 of the plate 200 may not be positioned adjacent or near an outer perimeter of the sole structure 104. Instead, the plate 200 may be positioned inwardly from the outer perimeter of the sole structure 104. In such an embodiment, the user may need to use a tool to remove the plate 200 from the sole structure 104. The tool may have a hook or latching element that can pull the plate 200 out of the cavity 270. The tool may also be used to disengage the plate 200 from the sole structure 104. Further, in some embodiments, the tool may have a magnet that can secure to the plate 200 and remove the plate 200 from the cavity 270. Furthermore, in some embodiments, the tool can be used to latch and/or secure the plate 200 to the sole structure 104, i.e., the tool may be used for inserting the plate 200 into the cavity 270.

In some embodiments, the longitudinal length of the plate 200 may be less than about 99% of the longitudinal length of the sole structure 104, or less than about 90% of the longitudinal length of the sole structure 104, or less than about 80% of the longitudinal length of the sole structure 104, or less than about 70% of the longitudinal length of the sole structure 104, or less than about 60% of the longitudinal length of the sole structure 104, or less than about 50% of the longitudinal length of the sole structure 104, or less than about 40% of the longitudinal length of the sole structure 104.

In particular embodiments, as discussed above, the plate 200 may be formed from an additive manufacturing process in which various layers of the plate 200 are printed during a printing process, such as any of the additive manufacturing processes mentioned above or disclosed within U.S. patent application Ser. No. 17/578,752, filed on Jan. 19, 2022, which is incorporated herein by reference in its entirety. In some embodiments, the plate 200 may comprise a plurality of composite layers. In some embodiments, the plate 200 may be formed from a composite or one or more layers of fibers, such as carbon fibers, aramid fibers, e.g., Kevlar®, boron fibers, glass fibers, natural fibers, and polymer fibers, or a combination thereof. In these embodiments, the fibers may be affixed or bonded to a substrate of plastic material, such as, e.g., nylon, epoxy, or ultra-high-molecular-weight-polyethylene (UHMWPE), or a textile material or composite, among other suitable materials. In some embodiments, the plate 200 may be formed from a unidirectional tape that includes carbon fibers, aramid fibers such as Kevlar®, boron fibers, glass fibers, polymer fibers, or any other material having high strength-to-weight properties. In some embodiments, the plate 200 may include a reinforcing member that strengthens the plate 200. In preferred embodiments, the plate 200 may include a reinforcing member that comprises carbon fiber.

As noted herein, the plate 200 may include an elliptical leaf spring design that has the capability of extreme flex. Therefore, the plate 200 may act as a spring while the user runs or walks. As outlined in the phases of gait below, the purpose of the plate 200 is to pre-load a spring at heel off, during the human gait cycle, resulting in the unloading of the spring upon toe-off. Since the leading spring cannot move the ground beneath the user, the spring moves the user. This loaded spring releases its energy as the user's foot pushes off the ground on the way to the next step. As illustrated in FIG. 4, the plate 200 is arched from the posterior segment 212 to the anterior segment 220. This orientation follows the center of mass during the gait cycle, assisting the flow of gait. Therefore, the plate 200 can be pre-loaded by the user just stepping on it. The plate 200 increases the plantar flexion moment (rate and amount of down force) at the inferior (bottom) of the metatarsal as it heads distally toward the toes, propelling the user forward or upward or any combination thereof, depending upon the activity. For example, a high jumper would require mainly lift (or force) upward, a long jumper would require lift (or force) upward and distance forward, and a sprinter would require forward force only.

A description of the four (4) phases of the gait cycle are described below with reference to the plate 200 and its spring-like effect:

Heel strike: When the foot initially contacts the ground while walking or running. At heel strike, the posterior segment 212 of the plate 200 deflects slightly, attenuating shock and allowing a smooth flow to the next phase.

Foot flat: When both the heel region 112 and the forefoot region 108 are on the ground at the same time. At this point the tibia and the user's body center of mass is passing over the foot. At foot flat, the plate's 200 slight arch from the posterior segment 212 to the anterior segment 220 provides a pre-load to increase the spring force going into the next phase.

Heel off: When the foot is flexed with the heel region 112 off of the ground. At heel off, when the foot is maximally flexed, is when the potential energy (PE) of the plate 200 is stored ready to be released.

Toe off: When the foot leaves the ground on its way to the next step. At toe off, the potential energy stored in the foot flat and heel off is released explosively, increasing the force and rate of plantar flexion extension, propelling the user forward or upward or a combination thereof.

The article of footwear 100 and plate 200 combination assists the body's natural spring generated during gait. Therefore, propelling the user forward or upward since the ground below the user cannot be moved. As noted herein, the force produced by the plate 200 acting as a spring that propels the user forward or upward (or any combination thereof) is defined herein as propulsion.

Over time, the plate 200 may degrade and its properties may change from repeated force being applied to the plate 200. Put differently, after numerous gait cycles, properties of the plate 200 may weaken or diminish, e.g., reduced or weakened propulsion. In some instances, the plate 200 may experience fatigue and some deformation of the plate 200 during the gait cycle may become permanent, i.e., the plate 200 does not always spring back to its original orientation. In other words, the plate 200 may lose stiffness over time. Therefore, the plate 200 may wear out and provide less support, propulsion, and/or stiffness than it originally did. Thus, after some period of use, it would be beneficial to replace the plate 200 without needing to replace the entire article of footwear 100. To wit, the article of footwear 100 of the present disclosure can include the plate 200 that is replaceable to provide effective support, propulsion, and/or stiffness to the user throughout the lifecycle of the article of footwear 100.

In some embodiments, the user can replace the plate 200 after the plate 200 has lost about 0.1% of it propulsion, or about 1% of its propulsion, or about 2% of its propulsion, or about 5% of its propulsion, or about 10% of its propulsion, or about 20% of its propulsion, or at least 0.1% of its propulsion, or at least 1% of its propulsion, or at least 2% of its propulsion, or at least 5% of its propulsion, or at least 10% of its propulsion, or at least about 20% of its propulsion.

Further, as discussed above, it can also be desirable to swap out plates 200 depending on the activity that is being performed. Therefore, the user may obtain various plates 200 with different lengths, widths, curvatures, stiffnesses, materials, and angles that can be swapped out at any time depending on the activity that will be performed by the user. For example, a plate 200 that provides more forward force may be replaced with a plate 200 that provides more upward force during the "spring back" if the user would like to increase their vertical jump, e.g., while playing basketball. Further, a stiffer plate 200 may be used for a user who plans to run a marathon or long race. Still further, a lighter plate (or no plate at all) may be used if the user would like a lighter article of footwear 100, i.e., taking a walk. As such, the article of footwear 100 can include various replaceable plates 200 that affect the performance of the article of footwear 100.

In some embodiments, as discussed above, the plate 200 can be customized during the manufacturing process to fit the specific traits or characteristics of the user. For example, the user may buy the article of footwear 100 that comprises a generic plate 200 therein. After purchase, the user may go to a fitting location to measure the characteristics of the user's foot, i.e., size of foot, contours of foot, angle of foot, arch of foot, toe length, etc., and gait cycle. Further the user may indicate what activities the user plans to participate in and/or what performance values that the user is looking for. After the data is collected and processed, a customized plate 200 may be manufactured via additive manufacturing (or conventional manufacturing) that fits the specific characteristics of the user. Once the customized plate 200 is created, the user may remove the generic plate 200 in the article of footwear 100 and replace it with the customized plate 200. Therefore, the plate 200 can be customized specifically for the user to help the user perform the best in the desired activity. In some embodiments, the user can have multiple plates 200 created that are all specific to a particular activity or type of sport.

As discussed above, the plate 200 can be deformed by the interaction with the sole 104 and experience stress that can alter or influence the properties, e.g., stiffness and propulsion, in one or more directions during use. Such stress caused by assembly with the footwear 100 can provide reactivity benefits that, when combined with the tuned stiffness and geometry of the plate 200, yield enhanced customization of the plate 200 within the footwear 100. As used herein, the term "reactivity" may refer to the sensitivity of the plate 200 to an applied load, i.e., the external forces applied during use, whether the applied load is due to the weight of the user or due to activities, e.g., running, walking, jumping, changing directions, lifting, and the like, and also refers to the sensitivity of the plate 200 to deformation in one or more directions. In some embodiments, the reactivity of the plate 200 can vary along the anterior segment 220, the arch segment 216, and the posterior segment 212, and reactivity can vary between the lateral side 116 and the medial side 118. In some instances, the arch segment 216 of the plate 200 can be pre-loaded to have increased reactivity, making the plate 200 more sensitive to walking activities in which smaller amounts of deformation is experienced, while still providing increased propulsion and support benefits to the user. In some embodiments, the anterior segment 220 may be provided with increased reactivity to offer maximum propulsion when a user presses off during jumping activities.

In some embodiments, the plate 200 may be disposed at an angle between the upper 102 and the outsole 174, such that the anterior segment 220 is spaced farther from the upper 102 than the posterior segment 212. In this way, the posterior segment 212 is positioned vertically higher, i.e., elevated in the Z direction, in relation to the anterior segment 220 and/or the arch segment 216. Thus, the plate 200 may be disposed to promote propulsion or spring-back during use. Further, the plate 200 can be formed in different shapes and with different curvatures along the reference axis 224 and/or between the medial side 118 and lateral side 116 to promote cushioning, propulsion, and support during use.

Referring to FIGS. 4 and 6, the plate 200 may also comprise an indicator 320 thereon. In some embodiments, the indicator 320 may be positioned on the top side 204 or the bottom side 208 of the plate 200. The indicator 320 can include text, letters, or information regarding the characteristics of the plate 200. For example, the indicator 320 on the plate 200 may indicate the length of the plate 200, i.e., longitudinal length of the plate 200, the stiffness of the plate 200 or a stiffness value, the material properties of the plate 200, the lifespan of the plate 200, the width of the plate 200, the materials used to create the plate 200, the strength of the plate 200, the duration until fatigue, and/or the propulsion provided by the plate 200. In some embodiments, the indicator 320 may include color, notches, stripes, symbols, numbers, and/or letters. In some embodiments, the indicator 320 may indicate when the plate 200 is expected to degrade or when the plate 200 has degraded. In some embodiments, the indicator 320 may be a chemical reaction that takes place within the plate 200. For example, once the plate 200 has started to degrade, or as the properties of the plate 200 change, e.g., stiffness, spring effect, and/or propulsion, the plate 200 may undergo a chemical reaction that indicates to the user that the user should replace the plate 200. In some embodiments, the plate 200 may change color (or a symbol may appear) through a chemical reaction once it is time to replace the plate 200. Therefore, the indicator 320 may indicate a depleted condition. In some embodiments, the indicator 320 may include a sensor that notifies the user once the plate 200 should be replaced.

Figure 7:
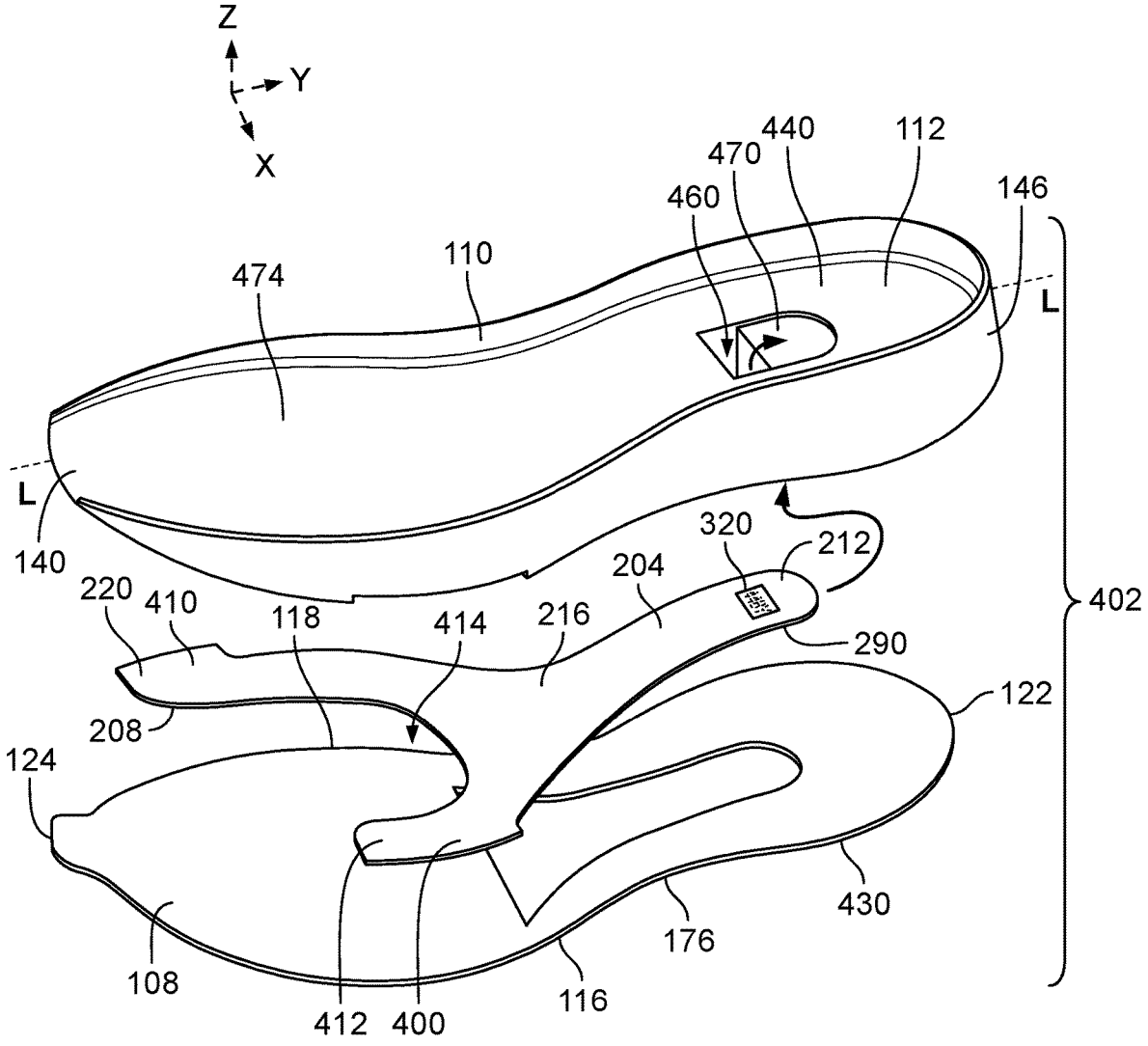
FIG. 7 is an exploded view of another embodiment of a sole structure incorporating still another embodiment of a plate.

Referring to FIG. 7, another embodiment of a plate 400 is provided for use within a sole structure 402 for the article of footwear 100. The plate 400 and the sole structure 402 of FIG. 7 have similarities to the plate 200 and sole structure 104; thus, like reference numerals are used to indicate like elements. Further, it is noted herein that the plate 400 can perform in a similar fashion as the plate 200. Therefore, the plate 400 may act as a spring and provide propulsion to the user. Further, the plate 400 can be customized and created in a similar way as described above with respect to the plate 200.

Referring still to FIG. 7, the plate 400 includes a medial fork 410 and a lateral fork 412 that are separated by a gap 414 within the anterior segment 220 of the plate 400. The plate 400 narrows, i.e., measured in the X direction, relative to the reference axis 224 moving in the longitudinal direction toward the heel end 146. That is, the plate 400 narrows from the anterior segment 220 to the arch segment 216 and also narrows from the arch segment 216 to the posterior segment 212. In the illustrated embodiment, the sole structure 402 further includes an outsole 430 and a midsole 440 to which the plate 400 is attached.

Similar to the plate 200, the plate 400 can be removably secured with the sole structure 402. Therefore, if desired by the user, the plate 400 may be removed from the article of footwear 100 and replaced with another plate 400. However, as discussed in further details below, a portion of the plate 400 is positioned below the midsole 440 when the plate 400 is secured to the article of footwear 100. Specifically, as illustrated in FIG. 7, the medial fork 410 and the lateral fork 412 of the plate 400 are positioned between the midsole 440 and the outsole 430 of the sole structure 402. Therefore, the sole structure 402 does not comprise the cavity 270 within the midsole 440, similar to the sole structure 104 (see FIGS. 1-6).

Referring to FIGS. 1-3 and 7, the plate 400 is provided as part of a sole structure 402 that is configured to be assembled with the upper 102. In particular, the plate 400 is configured to be positioned between the outsole 430 and the upper 102, such that the plate 400 is in contact with both the outsole 430 and the upper 102. To that end, the plate 400 is configured to extend through the midsole 440 and, specifically, the posterior segment 212 of the plate 400 extends through a slot 460 formed through the midsole 440 (see arrows in FIG. 7). In the illustrated embodiment, the plate 400 curves gradually along the anterior segment 220 and the arch segment 216 relative to the longitudinal axis L, and the plate 400 has an increased curvature relative to the longitudinal axis L along the arch segment 216 and the posterior segment 212 as compared to the curvature in the anterior segment 220.

When assembled, the posterior segment 212 of the plate 400 rests on a platform 470 to be flush with a bed 474 of the midsole 440. When the upper 102 is attached to the midsole 440, the insole 126 of the upper 102 is positioned along the bed 474 and the posterior segment 212 of the plate 400. Accordingly, when the sole structure 402 is assembled, the plate 400 is disposed at a downward angle relative to the longitudinal axis L extending in the X and Y directions and that is coplanar with at least a portion of the bed 474 of the midsole 440 and/or the insole 126 of the upper 102. The downward angle is at least about 5 degrees, but may be 10 degrees or greater. At such a downward angle and in combination with the particular curvature, the plate 400 is configured to deflect under applied loading during use, which causes the plate 400 to spring-back and, thus, to provide propulsion to the user's gait at light loads, e.g., mere walking strides, similar to the plate 200 described above. In combination with the particular shape and size of the plate 400, as mentioned above, the plate 400 is arranged within the sole structure 402 to increase reactivity, whereby propulsion is produced more easily, i.e., at lighter applied loads, in comparison to a plate that is laid flat along the midsole 440.

As discussed above, the plate 400 is configured to be removed from the sole structure 402. In some embodiments, the midsole 440 may be configured to detach from the outsole 430 and/or the upper 102 to allow the plate 400 access therein. In one non-limiting example, the midsole 440 of the sole structure 402 may be hinged to the outsole 430 such that an opening may be created between the midsole 440 and the outsole 430 to insert the plate 400 therein. In some embodiments, the article of footwear 100 may comprise a cable system to loosen the midsole 440 from the upper 102 and/or the outsole 430 in order for the user to insert the plate 400 therein. Further, in some embodiments, the upper 102 may be secured directly with the outsole 430 such that the midsole 440 may be capable of being removed from the article of footwear 100 entirely. In such an example, the user may remove the midsole 440 from the article of footwear 100 and replace the plate 400 thereafter. Put differently, the midsole 440 may be removed from the article of footwear 100 and then a different plate 400 may be secured to the midsole 440 through the slot 460. The midsole 440 and the newly added plate 400 may then be secured to the article of footwear 100.

Figure 8:
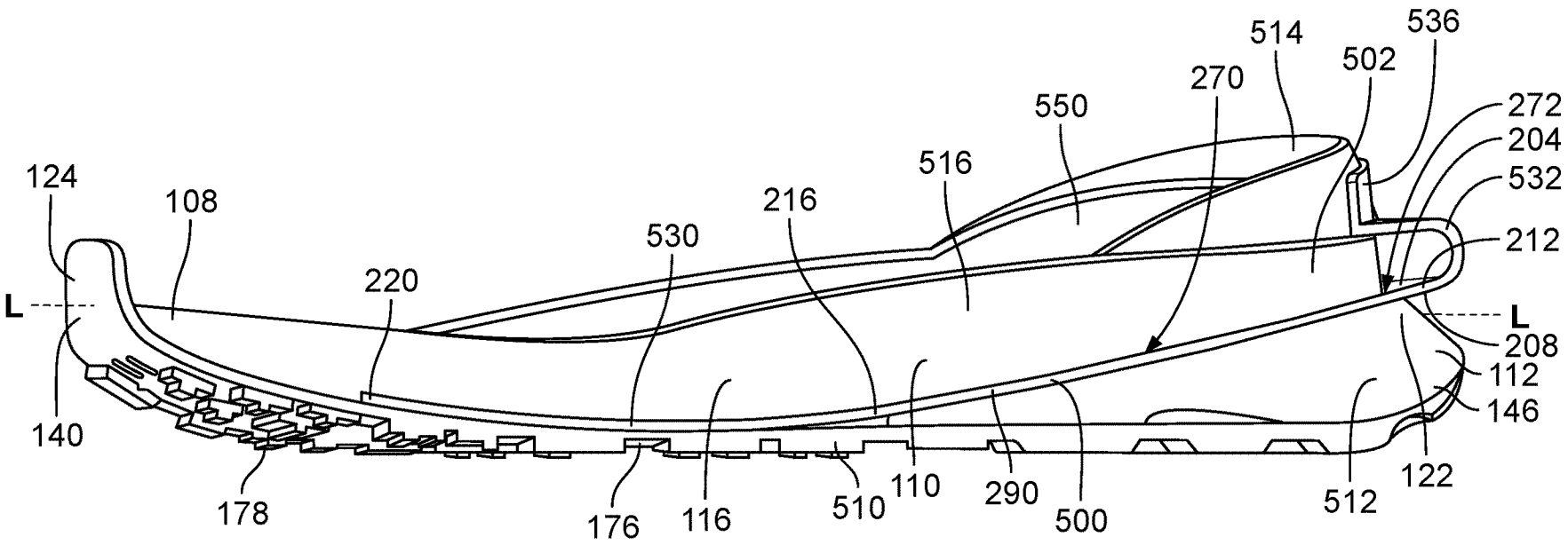
FIG. 8 is yet another embodiment of a sole structure incorporating another embodiment of a plate.
Figure 9:
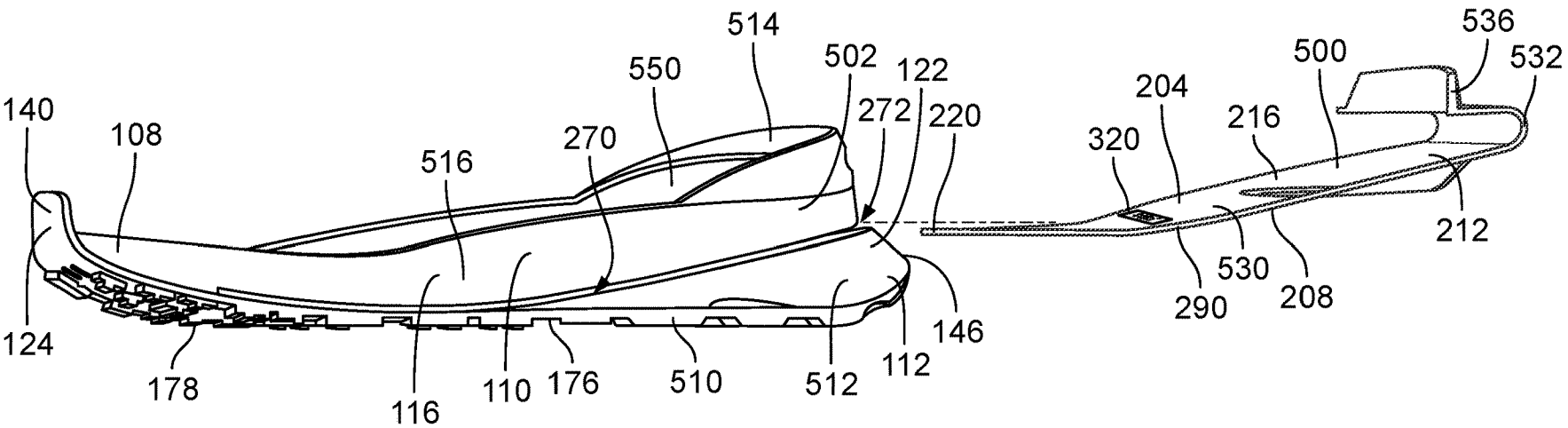
FIG. 9 is an exploded view of the sole structure of FIG. 8.

Referring to FIGS. 8 and 9, another embodiment of a plate 500 is provided for use within a sole structure 502 for the article of footwear 100. The plate 500 and the sole structure 502 of FIG. 8 have similarities to the plate 200 and sole structure 104; thus, like reference numbers are used to indicate like elements. Further, it is noted herein that the plate 500 can perform in a similar fashion as the plate 200, 400. Therefore, the plate 200 may act as a spring and provide propulsion to the user. Further, the plate 500 can be customized and created in a similar way as discussed above with respect to the plate 200, 400.

Referring still to FIGS. 8 and 9, the sole structure 502 includes an outsole 510, the plate 500, a heel cushioning member 512, a heel support collar 514, and a midsole 516. The plate 500 includes a base portion 530 and an arched, curved, or C-shaped rear portion 532 that connects with the base portion 530 adjacent the heel end 146 of the sole structure 502. The rear portion 532 comprises an upwardly extending flange 536 opposite the base portion 530. The base portion 530 slopes downward at an angle from the rear portion 532 in the posterior segment 212 of the plate 500. In other words, relative to the longitudinal axis L, the base portion 530 of the plate 500 slopes downward as it extends from the rear portion 532. The plate 500 flattens out, i.e., generally parallel with the longitudinal axis L, in the arch segment 216 of the plate 500 and then has a slightly upward angle or slope toward the anterior segment 220 of the plate 500. As illustrated in FIG. 8, the plate 500 can be seen from the exterior of the midsole 516. Therefore, the plate width PW is generally the same as (or larger than) the sole width SW. In some embodiments, the plate 500 may not be seen from an exterior of the sole structure 502 or midsole 516.

Referring still to FIGS. 8 and 9, the midsole 516 includes an upwardly extending sidewall 550 and the upwardly extending flange 536 may wrap around the sidewall 550 when the plate 500 is attached to the sole structure 502. In some embodiments, the plate 500 may not comprise the upwardly extending flange 536 on the rear portion 532. As noted herein, a portion of the plate 500 may be positioned both above and below the midsole 516 at a particular location along the sole structure 502. For example, near the heel region 112 of the sole structure 502, the base portion 530 of the plate 500 is positioned below the midsole 516 and the upwardly extending flange 536 of the plate 500 is positioned above the midsole 516. In some embodiments, the base portion 530 of the plate 500 may be positioned within the midsole 516 instead of below it. Further, in some embodiments, a portion of the base portion 530 of the plate 500 may be positioned within the midsole 516 and a portion of the base portion 530 of the plate 500 may be positioned below the midsole 516.

Similar to the plate 200, 400, the plate 500 is configured to be removably attached with the sole structure 502. Therefore, if desired by the user, the plate 500 may be removed from the sole structure 502 and the article of footwear 100 and replaced with another plate 500. As illustrated in FIG. 9, the plate 500 can slide out (and inserted therein) from the heel region 112 of the article of footwear 100. The rear portion 532 of the plate 500 can act as a handle or grip in order to assist the user while removing and inserting the plate 500. Specifically, the user can grab on to the rear portion 532 to remove the plate 500 from the sole structure 502. Additionally, the user can grab on to the rear portion 532 and use it to insert the plate 500 into the sole structure 502. In some embodiments, the plate 500 may not comprise the rear portion 532. For example, the plate 500 may end before the heel region 112 of the article of footwear 100. Further, it is contemplated that the rear portion 532 may comprise different shapes or configurations as it extends outwardly from the sole structure 502. In some embodiments, the plate 500 may engage with portions of the midsole 516 to lock the plate 500 in place within the sole structure 502.

As noted herein, various configurations and/or shapes can be used for the plate 200, 400, 500. Therefore, the plate 200, 400, 500 can be specifically designed to provide advantageous features to the user. In some embodiments, the plate 200, 400, 500 may be similar to the plates disclosed in U.S. patent application Ser. No. 17/082,327, filed on Oct. 28, 2020, which is incorporated herein by reference in its entirety.

Figure 10:
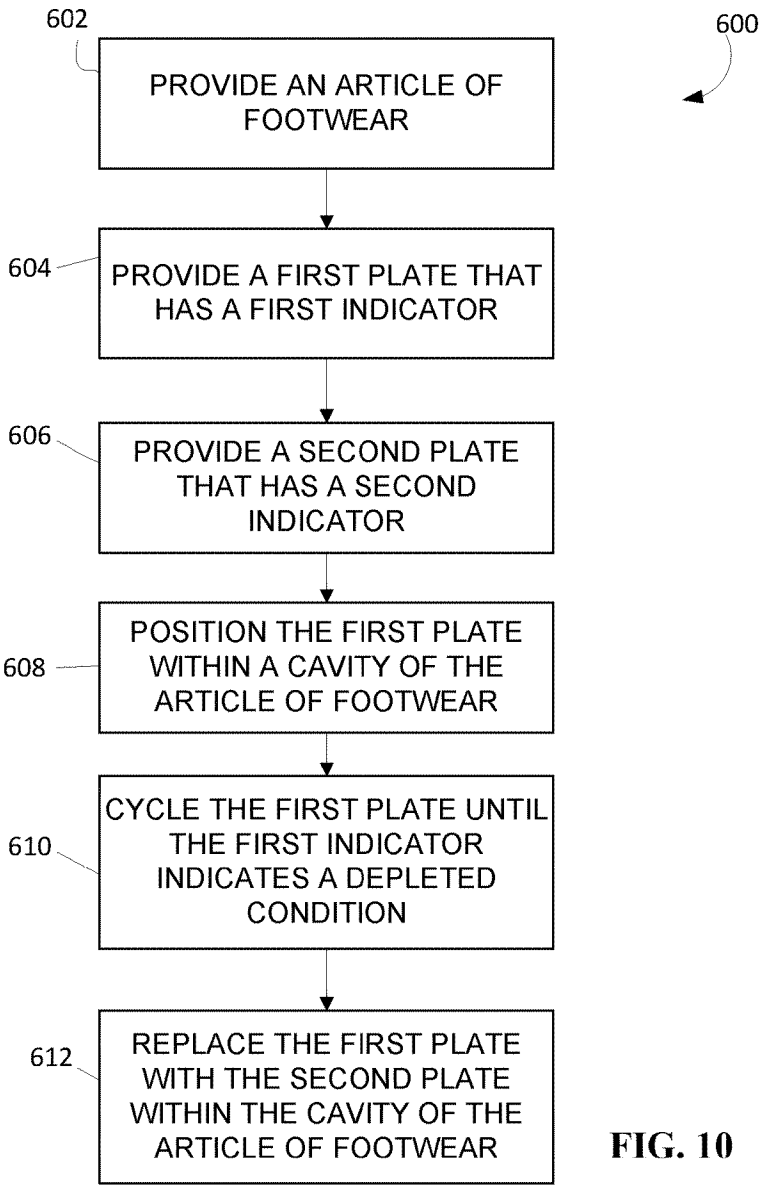
FIG. 10 depicts a flowchart for an example process for using a modular plate system.

FIG. 10 depicts a flowchart illustrating a process 600 for using a modular plate system. The process 600 can be used with any of the plates 200, 400, 500 described above with the article of footwear 100. In some embodiments, plates 200, 400, 500 can be interchanged or replaced with different plates 200, 400, 500. For example, plate 200 may be replaced with plate 500 in the article of footwear 100. While the example process is described with reference to the flowchart illustrated in FIG. 10, various other methods of using the modular plate system may alternatively be used. For example, the order of execution of the blocks may be rearranged, changed, eliminated, and/or combined to perform the process 600.

In step 602, the process 600 includes providing an article of footwear, e.g., article of footwear 100. In some embodiments, the article of footwear 100 may comprise the cavity 270 to receive the plate 200, 400, 500. In step 604, the process includes providing a first plate, i.e., plate 200, 400, 500, that has a first indicator, i.e., indicator 320. Further, in step 606, the process 600 includes proving a second plate, i.e., plate 200, 400, 500 that has a second indicator, i.e., indicator 320. The first plate and the second plate can comprise any of the plates 200, 400, 500 disclosed herein, and the first indicator and the second indicator can be similar to the indicator 320 disclosed herein. In some embodiments, the first plate may be different than the second plate and the first indicator may be different than the second indicator.

In step 608, the process 600 includes positioning the first plate within a cavity, e.g., the cavity 270, of the article of footwear, i.e., article of footwear 100. In particular, as discussed above, the user can insert the plate 200, 400, 500 into the cavity 270 to secure the plate 200, 400, 500 to the article of footwear 100. In step 610, the process 600 includes cycling the first plate until the first indicator indicates a depleted condition. In particular, the user can continue to use and wear the article of footwear 100 with the plate 200, 400, 500 therein until the indicator 320 on the plate 200, 400, 500 indicates a depleted condition. As discussed above, this depleted condition can be when the plate 200, 400, 500 loses some stiffness or degrades in a particular way. In some embodiments, the depleted condition may just be after the user takes a certain number of steps. For example, the depleted condition may be when the user takes about 3 million steps, or about 2 million steps, or about 1 million steps, or about 750,000 steps, or about 500,000 steps, or about 250,000 steps, or about 100,000 steps, or at least 100,000 steps, or at least 250,000 steps, or at least 500,000 steps, or at least 750,000 steps, or at least 1 million steps, or at least 2 million steps, or at least 3 million steps with the article of footwear 100 and plate 200, 400, 500.

In step 612, the process 600 includes replacing the first plate with the second plate within the cavity of the article of footwear. In particular, the user can replace the plate 200, 400, 500 with another plate 200, 400, 500 once the indicator has indicated a depleted condition. In some embodiments, the user can replace the plate 200, 400, 500 by removing the plate 200, 400, 500 from the cavity 270 via the slot 272 and inserting a new plate 200, 400, 500 therein. The second plate can then be used for an extended period of time until the second indicator indicates that the second plate should be replaced. The user can then replace the second plate with a third plate. This process 600 can be repeated for multiple plates over time.

Figure 11:
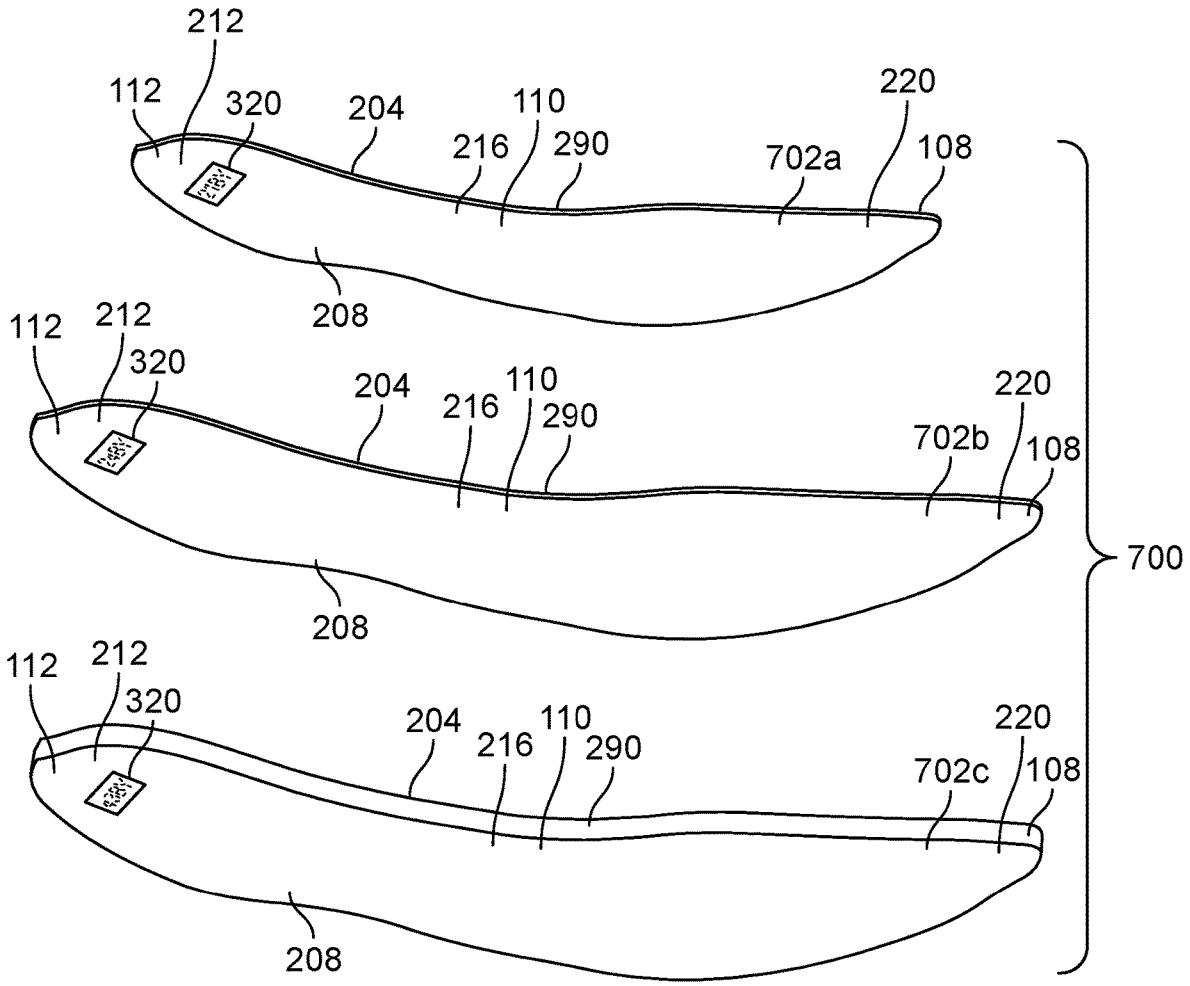
FIG. 11 is a perspective view of a modular plate kit.

Referring to FIG. 11, a modular plate kit 700 is shown. The kit 700 may include one or more plates 200, 400, 500 therein. In the present embodiment, the kit 700 includes a first plate 702*a*, a second plate 702*b*, and a third plate 702*c*. As noted herein, plates 702*a*, 702*b*, 702*c* are similar to the plate 200. However, in some embodiments, the kit 700 may comprise plates 702*a*, 702*b*, 702*c* similar to plates 400, 500 described above with respect to FIGS. 7-9. In some embodiments, the kit 700 may include various plates 702*a*, 702*b*, 702*c* with various performance characteristics. Therefore, the user may be able to purchase the kit 700 and interchange the user's plates 702*a*, 702*b*, 702*c* within the article of footwear 100. In one non-limiting example, each of the plates 702*a*, 702*b*, 702*c* in the kit 700 may be used for a different activity. For example, one of the plates 702*a*, 702*b*, 702*c* in the kit 700 may be used for long distance running, e.g., a stiffer plate, one of the plates 702*a*, 702*b*, 702*c* in the kit 700 may be used for sprinting, one of the plates 702*a*, 702*b*, 702*c* in the kit 700 may be used for jumping, e.g., for more upward propulsion, and/or one of the plates 702*a*, 702*b*, 702*c* in the kit 700 may be used for walking, e.g., a plate with less stiffness. As outlined above, the user can use the kit 700 to replace the plate 702*a*, 702*b*, 702*c* within the article of footwear 100. In some embodiments, the plates 702*a*, 702*b*, 702*c* in the kit 700 may comprise different thicknesses, lengths, widths, strengths, and/or material properties. For example, the second plate 702*b* may comprise a smaller length and the third plate 702*c* may be thicker. In some embodiments, the plates 702*a*, 702*b*, 702*c* in the kit 700 may be formed from different materials or have different reinforcing members therein. In some embodiments, the kit 700 may include different types of plates 702*a*, 702*b*, 702*c*, e.g., the kit 700 may comprise the plate 200, the plate 400, and/or the plate 500. Thus, the kit 700 allows for additional user customization and a better user experience. As noted herein, in some embodiments, the kit 700 may comprise 1, 2, 3, 4, 5, 6, 7, 8, 9, 10, 11, or 12 plates 200, 400, 500, 702*a*, 702*b*, 702*c* therein.

Figure 12:
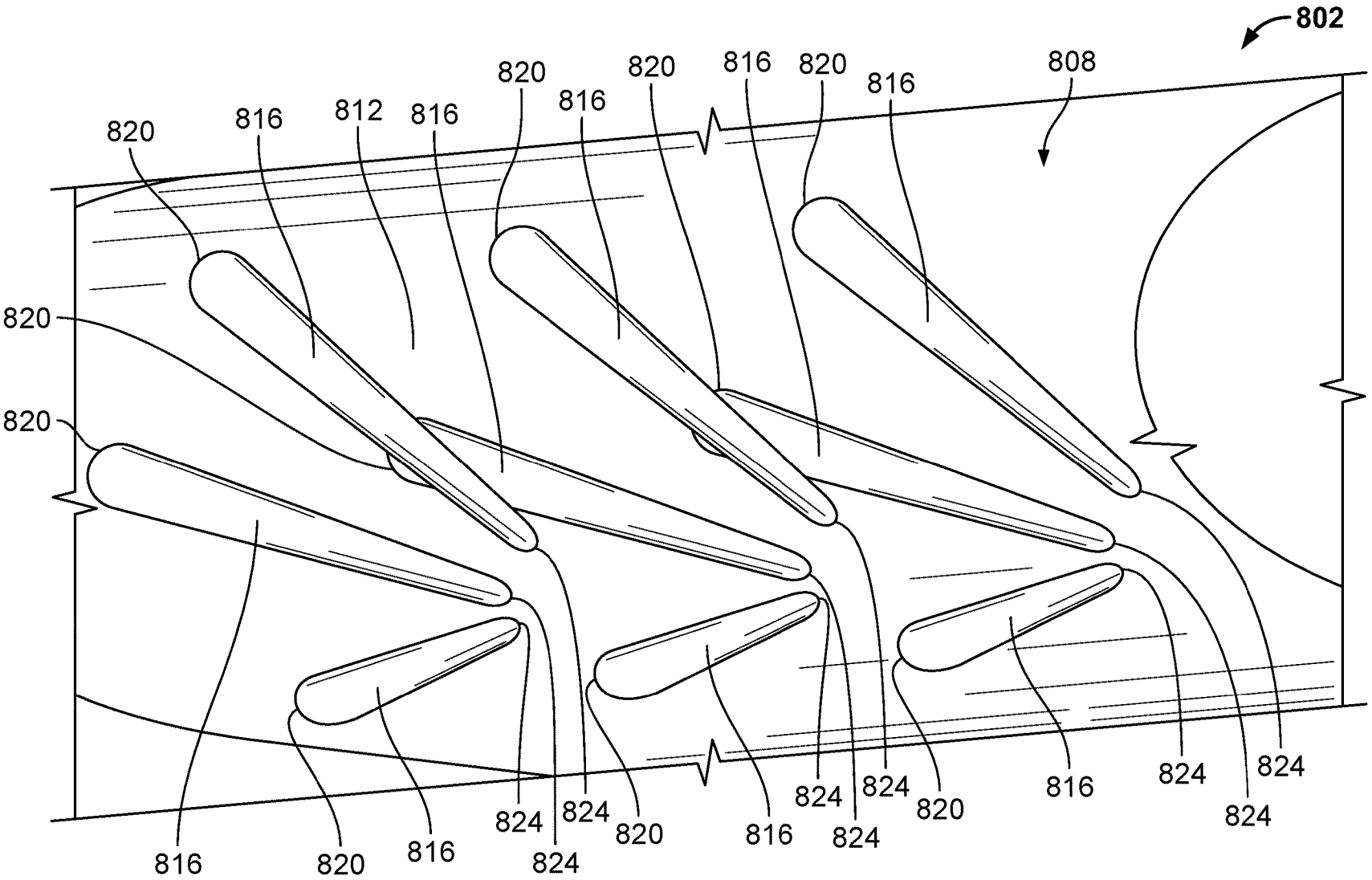
FIG. 12 is a partial perspective view of another embodiment of a cavity and sole structure.

Referring to FIG. 12, another embodiment of a sole structure 802 with a cavity 808 of the article of footwear 100 is provided. The cavity 808 and sole structure 802 of FIG. 12 have similarities to the cavity 270 and the sole structure 104; thus, like reference numerals are used to indicate like elements. As illustrated in FIG. 12, an inside of the cavity 808 within the sole structure 802 is shown, and a cavity wall 812 can form the cavity 808 within the sole structure 802. In some embodiments, a plurality of fingers 816 may extend from the cavity wall 812. Specifically, the plurality of fingers 816 can protrude out from the cavity wall 812 and extend into the cavity 808. In the illustrated embodiment, each of the plurality of fingers 816 includes a generally cylindrical or conical shape and includes a base or fixed end 820 and a tip or free end 824. In some embodiments, each of the plurality of figures 816 may be formed of various shapes and sizes, or may comprise additional retention features (not shown) for engagement with any of the plates 200, 400, 500, 702*a*, 702*b*, 702*c*, such as, e.g., a notch on the tip 824 of the finger 816.

Referring still to FIG. 12, the plurality of fingers 816 are configured to pivot about the base 820. In other words, the plurality of fingers 816 are biased such that they can move or pivot about the base 820 and snap back into their original configuration after they have been moved. Thus, the plurality of fingers 816 can act as a spring that is biased in the undeformed state shown in FIG. 12. As illustrated in FIG. 12, the plurality of fingers 816 are positioned in various rows and columns. Although only 3 fingers 816 are illustrated in each row and column herein, it is contemplated that the sole structure 802 can comprise any number of fingers 816. In some embodiments, the sole structure 802 can comprise 10, 20, 30, 40, 50, 60, 70, or more fingers 816 that extend from the cavity wall 812. Further, in some embodiments, the plurality of fingers 816 can extend around a periphery or section of the cavity 808. Therefore, in some embodiments, the plurality of fingers 816 can extend from a top or a bottom of the cavity wall 812.

Referring still to FIG. 12, the plurality of fingers 816 can help secure the plate 200 (see FIG. 6) within the cavity 808. In particular, in some embodiments, the arch segment 216 of the plate 200 may be larger than the posterior segment 212 of the plate 200 (see FIG. 6). Therefore, in some embodiments, the width of the cavity, i.e., measured parallel along the horizontal plane H in FIG. 5, may be wider than the plate width PW in some areas of the article of footwear 100 to account for the width differences in the plate 200. In order to limit movement of the plate 200 in these wider cavity areas, the sole structure 802 can comprise the plurality of fingers 816. In other words, the plate 200 can be secured within the cavity 808 by the plurality of fingers 816 to limit side to side movement during use. In one non-limiting example, the fingers 816 may be positioned within the heel region 112 of the cavity 808. Thus, while the user slides the plate 200 into the cavity 808, the anterior segment 220 and the arch segment 216 of the plate 200, which can be the widest sections of the plate 200 (see FIG. 6), can deform and/or pivot the plurality of fingers 816 to allow access therethrough. Once the arch segment 216 of the plate 200 is translated through the plurality of fingers 816, the plurality of fingers 816 can snap back to their original configuration and secure to the posterior segment 212 of the plate 200, thereby limiting sideways or vertical movement of the posterior segment 212 of the plate 200. In some embodiments, the posterior segment 212 of the plate 200 may be configured to be secured within retention features (not shown), e.g., notches, of the plurality of fingers 816. As discussed above, in some embodiments, the sole structure 802 may comprise any number of fingers 816 on each side such that the posterior segment 212 of the plate 200 is positioned between the tips 824 of the plurality of fingers 816. As noted herein, the fingers 816 can be positioned within any section of the cavity 808 and may be used to hold or secure the plate 200 in wider sections of the cavity 808.

Figure 13:
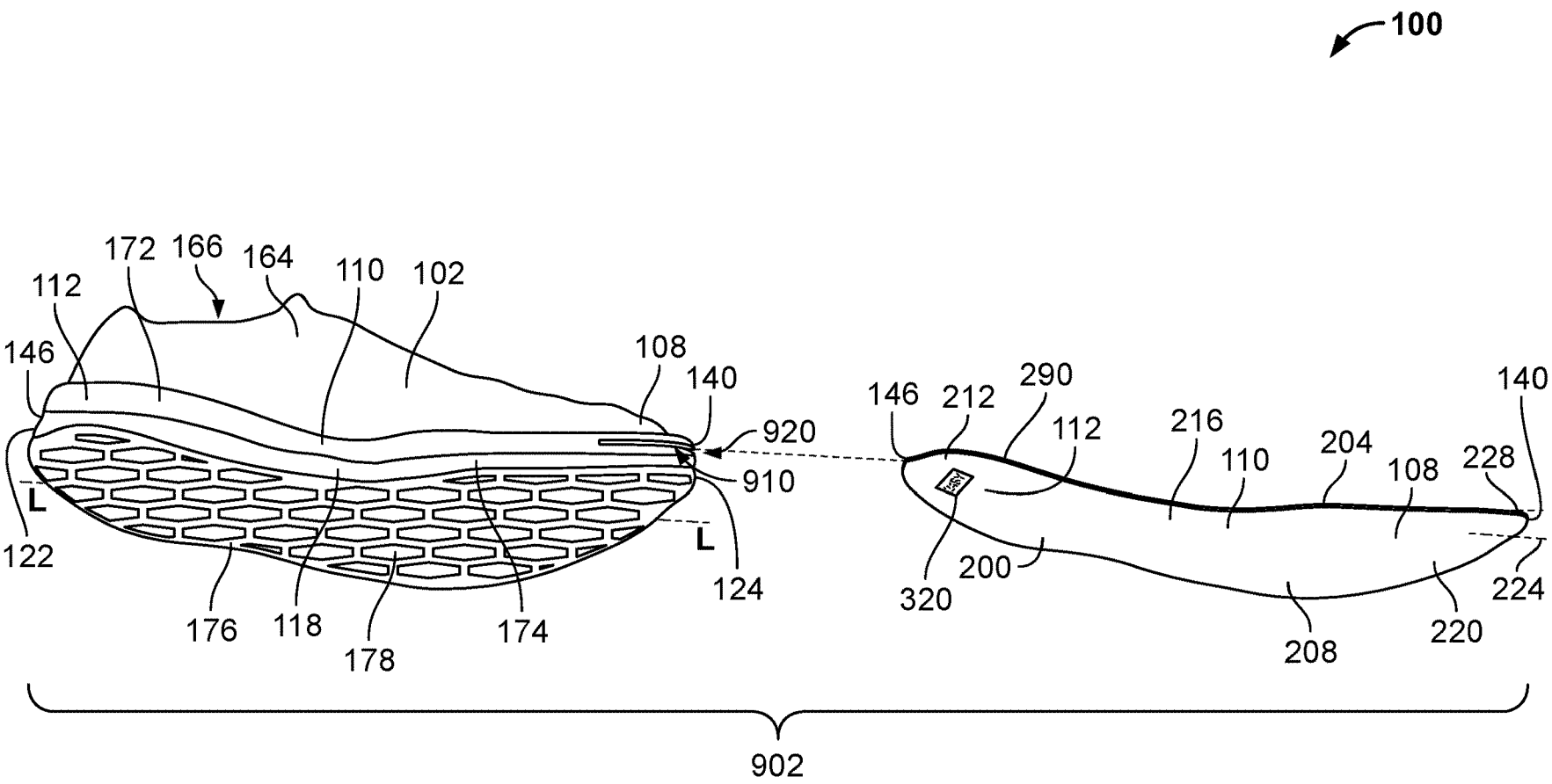
FIG. 13 is an exploded view of another embodiment of a sole structure.

Referring to FIG. 13, another embodiment of a sole structure 902 is provided for use within the article of footwear 100. The sole structure 902 of FIG. 13 has similarities to the sole structure 104; thus, like reference numbers are used to indicate like elements. As illustrated in FIG. 13, the sole structure 902 comprises a slot 910 that defines an entrance to a cavity 920 within the sole structure 902. Similar to the cavity 270, the cavity 920 is positioned within the midsole 172 and is configured to receive the plate 200 via the slot 910. In contrast to the slot 272, the slot 910 is positioned in the forefoot region 108 of the article of footwear 100. Therefore, the plate 200 can be inserted into the forefoot region 108 or toe end 140 of the midsole 172. As noted herein, the cavity 920 and the slot 910 can be identical to the cavity 270 and the slot 272 described above besides for the location on the article of footwear 100. In some embodiments, the slot 910 may be positioned on the lateral side 116 or the medial side 118 of the midsole 172.

Figure 14:
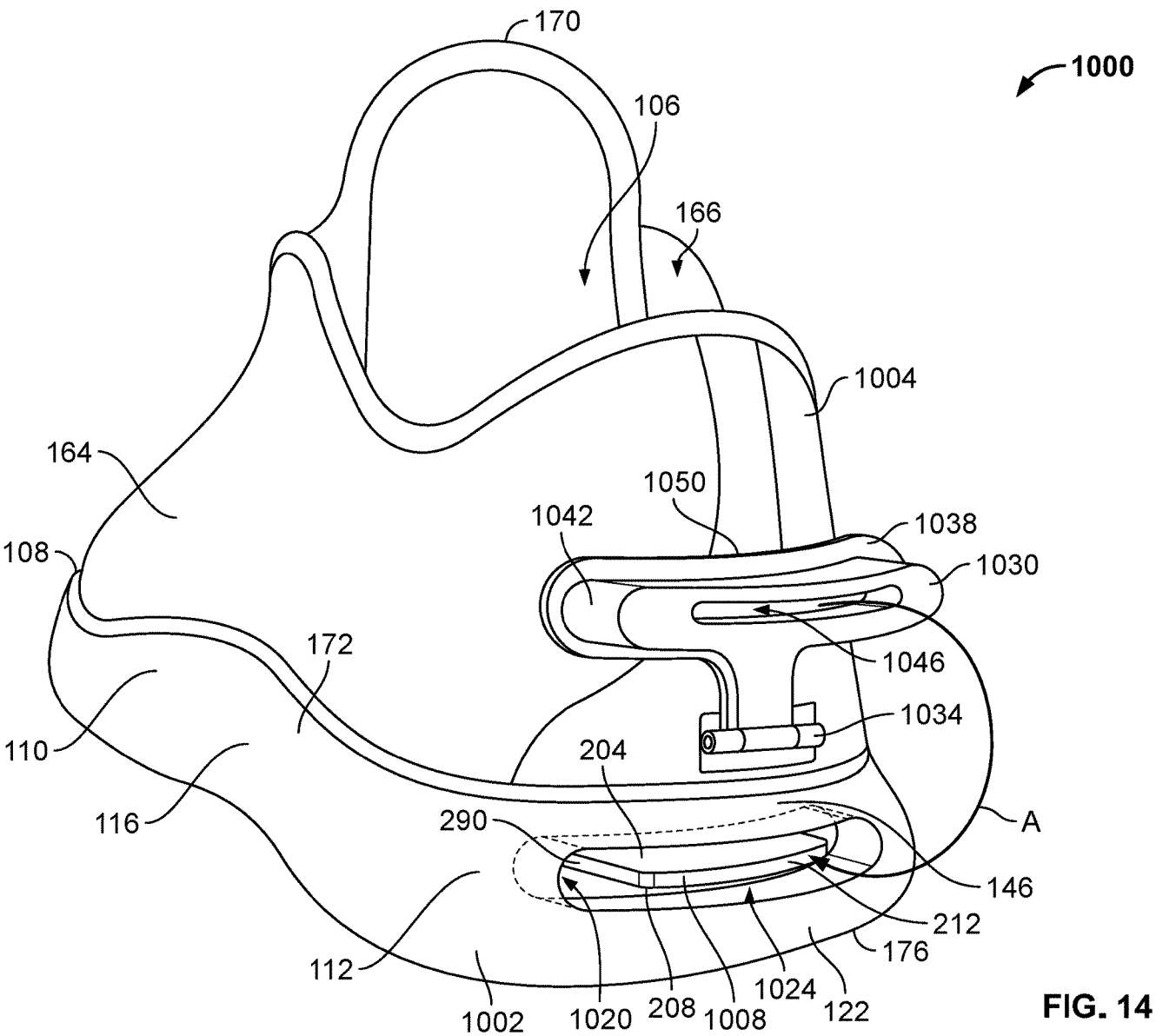
FIG. 14 is a perspective view of another embodiment of an article of footwear.

Referring to FIG. 14, anther embodiment of an article of footwear 1000 is illustrated. The article of footwear 1000 includes a sole structure 1002, an upper 1004, and a plate 1008. The article of footwear 1000 of FIG. 14 has similarities to the article of footwear 100; thus, like reference numbers are used to indicate like elements. Further, it is noted herein that the plate 1008 can be similar and perform in a similar manner as the plates 200, 400, 500, 702*a*, 702*b*, 702*c* described above. As illustrated in FIG. 14, the sole structure 1002 comprises a cavity 1020 that can receive the plate 1008 via a slot 1024. Similar to the slot 272, the slot 1024 is positioned within the heel region 112 of the midsole 172. The article of footwear 1000 further includes a flap 1030 that is attached above the slot 1024. In some embodiments, the flap 1030 may be attached to the upper 1004 by a hinge 1034 such that the flap 1030 can rotate with respect to the hinge 1034 between an open state and a closed state. As noted herein, FIG. 14 illustrates the flap 1030 in an open state.

Staying with FIG. 14, the flap 1030 includes a flap wall 1038 and a flap housing 1042 extending from the flap wall 1038. The flap housing 1042 includes a flap cavity 1046 extending within the flap housing 1042. In preferred embodiments, the flap cavity 1046 is configured to mate with the posterior segment 212 of the plate 1008. In other words, when the flap 1030 is positioned within the closed state, the flap cavity 1046 is configured to retain a portion of the plate 1008 therein. Therefore, similar to the fingers 816 described above with respect to FIG. 12, the flap housing 1042 can limit sideways or vertical movement of the plate 1008 within the sole structure 1002. Thus, the flap housing 1042 can extend around a portion of the plate 1008 and securely retain the plate 1008 within the sole structure 1002.

During use, the user can insert the plate 1008 within the cavity 1020 via the slot 1024 in a similar fashion as described above with respect to the plate 200. As noted herein, the plate 1008 can only be inserted into the slot 1024 when the flap 1030 is in the open state (see FIG. 14). Once the entire plate 1008 is positioned within cavity 1020, the user can rotate the flap 1030 (see arrow A in FIG. 14) to close the slot 1024. As discussed above, the flap 1030 can rotate about the hinge 1034. Thus, as the flap 1030 rotates about the hinge 1034, the user can align the flap cavity 1046 of the flap 1030 with a portion of the posterior segment 212 of the plate 1008. Once the plate 1008 is aligned with the flap cavity 1046, the user can finish rotating the flap 1030 to the closed state. While rotating the flap 1030 to the closed state, a portion of the plate 1008 will be lodged within the flap cavity 1046 to secure the posterior segment 212 of the plate 1008 to the flap 1030. As discussed above, the flap 1030 can limit movement of the plate 1008 and can further secure the plate 1008 within the midsole 172. Further, the flap 1030 can hide the slot 1024 once the flap 1030 is in the closed state, i.e., the flap 1030 can be flush with the heel region 112 of the article of footwear 1000. As noted herein, in some embodiments, an end 1050 of the flap 1030 can comprise various fastening systems to secure the flap 1030 to the sole structure 1002 in the closed state. For example, the flap 1030 may be secured to the sole structure 1002 in the closed state by clips, Velcro®, magnets, fasteners, and/or pins.

As noted herein, the flap 1030 is illustrated with the hinge 1034 and is provided as being coupled to the upper 1004 and/or sole structure 1002. In some embodiments, the flap 1030 may comprise a living hinge and may be integral with the sole structure 1002 and/or the upper 1004 (see FIG. 15). Further, in some embodiments, the hinge 1034 may be attached with the sole structure 1002. Still further, in some embodiments, the flap 1030 may be configured to automatically move between the open state and the closed state. Furthermore, in some embodiments, the flap 1030 may include a spring that biases the flap to the open state or the closed state. Still further, it is contemplated that the flap 1030 may comprise any shape or configuration suitable for securely retaining the plate 1008 within the cavity 1020.

Figures 15A, 15B:
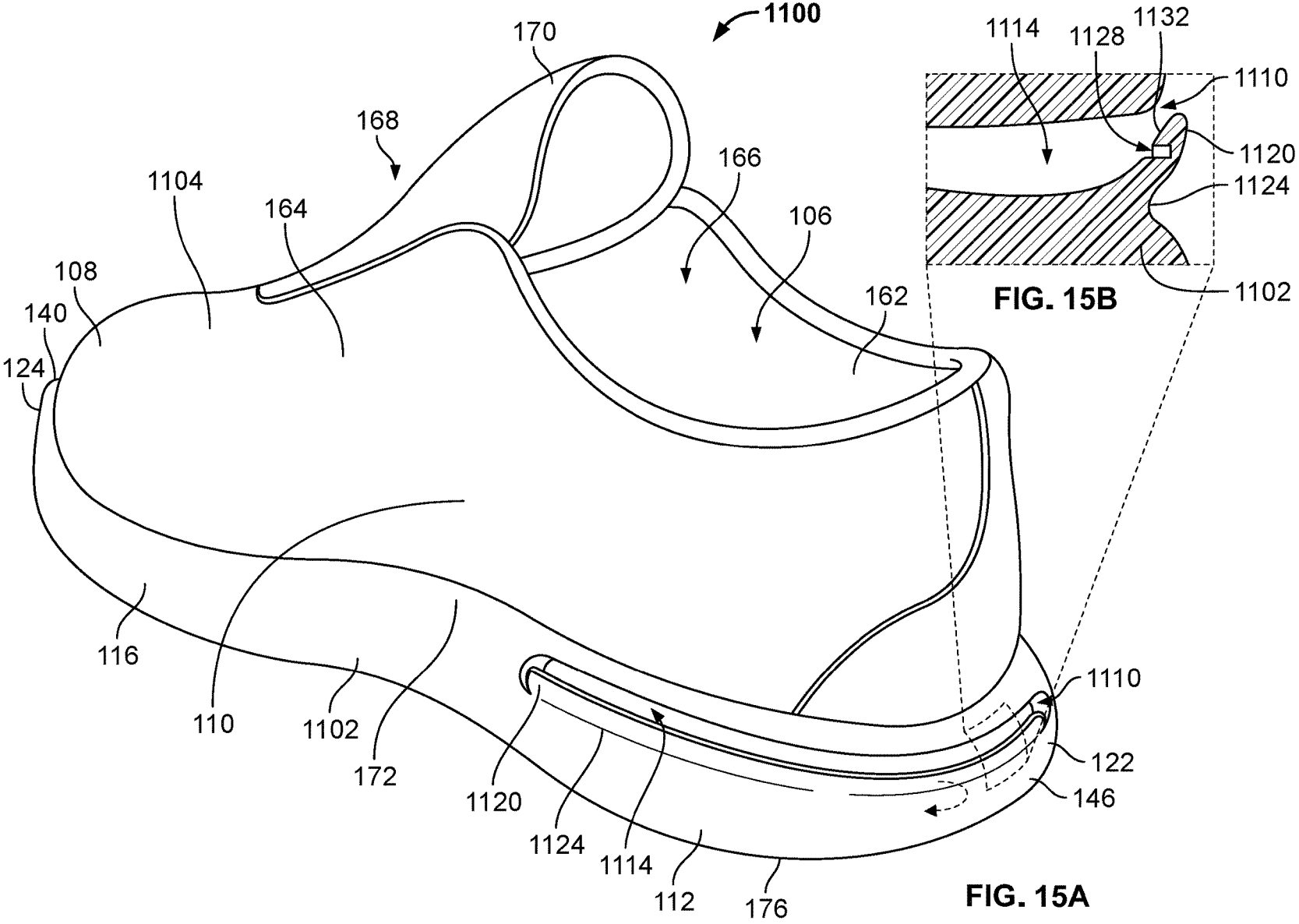
FIG. 15A is a perspective view of another embodiment of an article of footwear.
FIG. 15B is a partial cross sectional view of the article of footwear of FIG. 15A.

Referring to FIGS. 15A and 15B, another embodiment of an article of footwear 1100 is illustrated. As illustrated in FIG. 15A, the article of footwear 1100 includes a sole structure 1102 and an upper 1104. The article of footwear 1100 of FIG. 15A has similarities to the article of footwear 100; thus, like reference numbers are used to indicate like elements. Similar to the sole structure 104, the sole structure 1102 comprises a slot 1110 defining an entrance into a cavity 1114 within the midsole 172. As noted herein, the cavity 1114 may be identical to the cavity 270 described above. The slot 1110 is positioned in the heel region 112 of the sole structure 1102 and extends onto the lateral side 116 of the sole structure 1102. In some embodiments, the slot 1110 may extend a longer or shorter distance along the lateral side 116 of the sole structure 1102. Further, in some embodiments, the slot 1110 may extend along the medial side 118 of the sole structure 1102.

Referring still to FIGS. 15A and 15B, the sole structure 1102 includes a flap 1120 that extends adjacent to the slot 1110. In particular, the flap 1120 is configured to extend into and cover a portion of the slot 1110. The flap 1120 is configured to flex about a living hinge 1124 into and out of the cavity 1114 and form a movable barrier into the cavity 1114. Therefore, the flap 1120 is configured to deform to allow access to the slot 1110 and the cavity 1114. Similar to the flap 1120 described above with respect to FIG. 14, the flap 1120 is configured to securely retain the plate 200 within the cavity 1114. Specifically, as illustrated in FIG. 15B, the flap 1120 can include a notch 1128 on an interior surface 1132 of the flap 1120 that is configured to receive a portion of the plate 200. In preferred embodiments, the periphery 290 of the posterior segment 212 of the plate 200 is configured to be secured within the notch 1128 of the flap 1120. As discussed above, the notch 1128 of the flap 1120 can help limit movement of the plate 200 once the plate 200 has been inserted into the cavity 1114. In some embodiments, the flap 1120 is configured to cover a majority or a portion of the slot 1110. In some embodiments, the flap 1120 may completely cover the slot 1110. Still further, in some embodiments, the flap 1120 may not comprise the notch 1128 therein.

Referring still to FIGS. 15A and 15B, during use, the user can insert the plate 200 within the cavity 1114 via the slot 1110 in a similar fashion as described above with respect to the plate 200, i.e., aligning the anterior segment 220 of the plate 200 with the slot 1110. As the user inserts the plate 200 into the slot 1110, the flap 1120 can rotate/deform to an open position by way of the living hinge 1124 to allow the plate 200 therethrough. In some embodiments, the flap 1120 may deform by simply inserting the plate 200 into the cavity 1114. Alternatively, in some embodiments, the user may hold the flap 1120 down while the plate 200 is being inserted into the cavity 1114. Once the posterior segment 212 of the plate 200 is translated through the slot 1110, the flap 1120 can snap back to its original configuration in a closed position to secure the plate 200 therein. In some embodiments, the user may need to further position the plate 200 and/or the flap 1120 such that a portion of the plate 200 is positioned within the notch 1128 of the flap 1120. As noted herein, FIGS. 15A and 15B illustrate the flap 1120 in a closed position.

Referring still to FIGS. 15A and 15B, the flap 1120 is internally formed with the sole structure 1102. However, in some embodiments, the flap 1120 may be a separate component attached to or secured with the sole structure 1102. As noted herein, the flap 1120 is illustrated as extending upwardly from the sole structure 1102. However, in some embodiments, the flap 1120 may extend downwardly from the sole structure 1102 to cover the slot 1110. Further, in some embodiments, the sole structure 1102 may comprise multiple flaps 1120 extending over the slot 1110. For example, the sole structure 1102 may include two flaps 1120 that are on opposite sides of the slot 1110, i.e., one flap extending upwardly from the sole structure 1102 and one flap extending downwardly from the sole structure 1102 such that distal edges of the flaps 1120 are adjacent one another. In such an embodiment, each of the flaps 1120 may be deformed or rotate about a living hinge, e.g., the living hinge 1124, in order to form a movable barrier. As the plate 200 is urged into the slot 1110, the flaps 1120 may be displaced/rotate about the living hinges to allow access therein.

Figure 16:
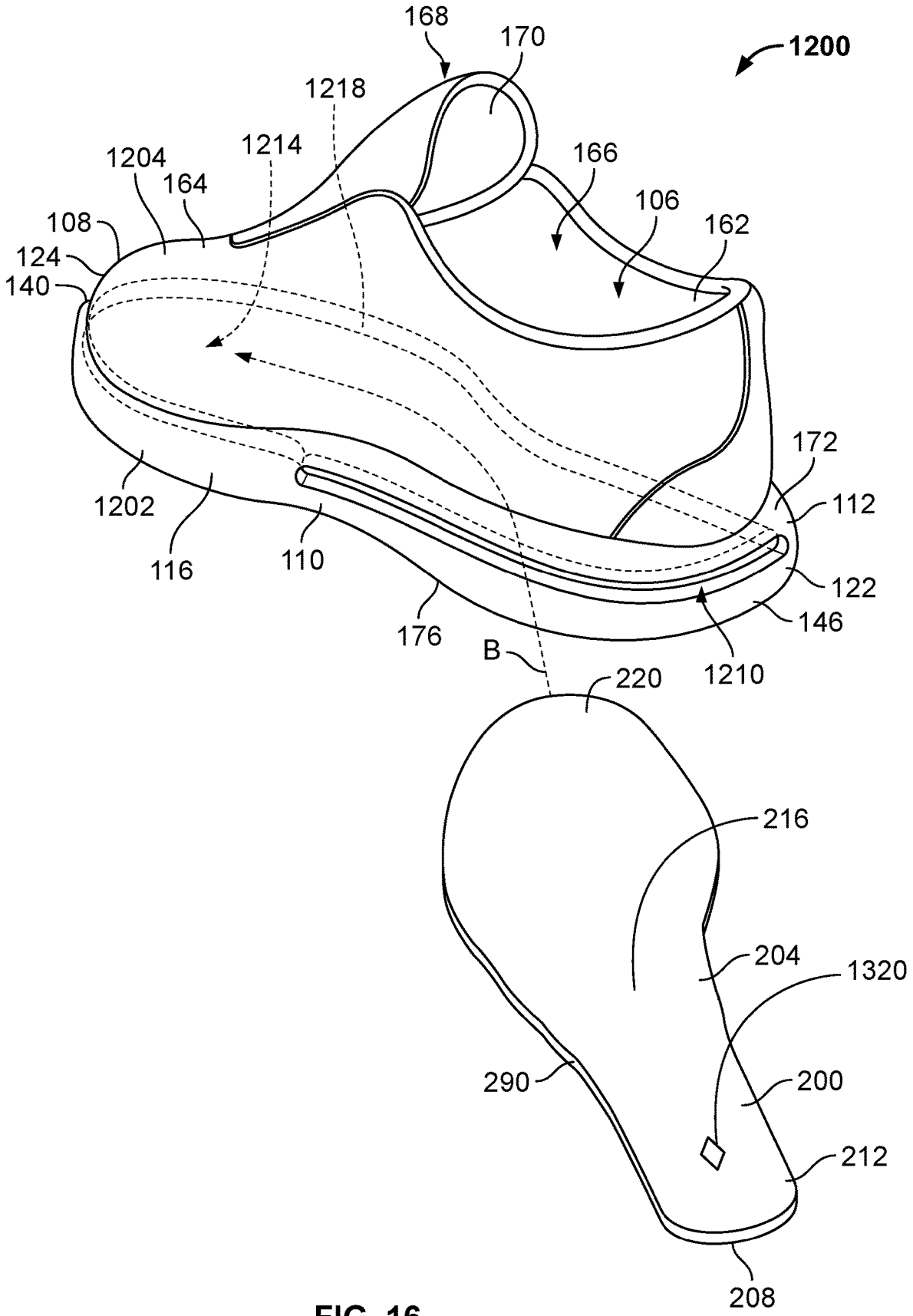
FIG. 16 is a perspective view of yet another embodiment of an article of footwear.

Referring to FIG. 16, another embodiment of an article of footwear 1200 is illustrated. As illustrated in FIG. 16, the article of footwear 1200 includes a sole structure 1202 and an upper 1204. The article of footwear 1200 of FIG. 16 has similarities to the article of footwear 100; thus, like reference numbers are used to indicate like elements. The sole structure 1202 comprises a slot 1210 that defines an entrance to a cavity 1214 (shown in dash-dash-dash lines). In contrast to previous embodiments, the slot 1210 in FIG. 16 extends within the heel region 112 of the midsole 172 and the lateral side 116 of the midsole 172. Put differently, the slot 1210 comprises a J-shape that extends around the heel region 112 and onto the lateral side 116 of the sole structure 1202. In some embodiments, the slot 1210 may extend along the heel region 112 and the midfoot region 110 of the sole structure 1202. The slot 1210 allows for the plate 200 to be inserted within the cavity 1214. As discussed above, the width of the plate 200 may vary throughout to conform to the shape of a human foot. Therefore, in some embodiments, the arch segment 216 and/or the anterior segment 220 of the plate 200 may be wider than the posterior segment 212. To account for this variation in width, in some embodiments, the sole structure 1202 can comprise the slot 1210 that extends on multiple sides to facilitate insertion in and removal from the cavity 1214.

Referring still to FIG. 16, during installation, the user can insert the plate 200 into the slot 1210 at an angle, as illustrated be the dashed line arrow B in FIG. 16. Once the anterior segment 220 of the plate 200 contacts a wall 1218 that defines an end of the cavity 1214, the user can rotate the plate 200 in a counter clockwise direction, i.e., the posterior segment 212 of the plate 200 is rotated toward the heel end 146 of the article of footwear 1200 to slide the entire plate 200 into the cavity 1214 via the slot 1210. Once the plate 200 is positioned within the cavity 1214, the plate 200 is secured therein by the width difference of the cavity 1214. In some embodiments, the slot 1210 may be positioned within the heel region 112 and the medial side 118 of the sole structure 1102 instead of the heel region 112 and the lateral side 116, as illustrated in FIG. 16.

As discussed above, the article of footwear 100, 1000, 1100, 1200 can comprise a wide variety of configurations to accommodate the various plates 200, 400, 500, 702*a*, 702*b*, 702*c*, 1008 therein. As noted herein, any of the embodiments described above may be interchangeable with a different embodiment. For example, any of the sole structures 104, 402, 502, 802, 902, 1002, 1102, 1202 described above may be used with any of the uppers 102, 1004, 1104, 1204. Further, any of the slots 272, 910, 1024, 1110, 1210 and/or cavities 270, 808, 920, 1020, 1114, 1214 described above can be used with any of the sole structures 104, 402, 502, 802, 902, 1002, 1102, 1202. Therefore, it is contemplated that the article of footwear 100, 1000, 1100, 1200 can comprise various combinations of the sole structures 104, 402, 502, 802, 902, 1002, 1102, 1202, uppers 102, 1004, 1104, 1204, slots 272, 910, 1024, 1110, 1210, and/or cavities 270, 808, 920, 1020, 1114, 1214.

Further, the plates 200, 400, 500, 702*a*, 702*b*, 702*c*, 1008 can be formed of various shapes and sizes and provided as part of the footwear 100, 1000, 1100, 1200, such as in the sole 104, 402, 502, 802, 902, 1002, 1102, 1202 or the upper 102, 102, 1004, 1104, 1204. Further, the plates 200, 400, 500, 702*a*, 702*b*, 702*c*, 1008 can be replaced with other plates 200, 400, 500, 702*a*, 702*b*, 702*c*, 1008 having specific characteristics, performance metrics, or stiffness. Furthermore, the plates 200, 400, 500, 702*a*, 702*b*, 702*c*, 1008 may also be replaced after a long time of activity. The plates 200, 400, 500, 702*a*, 702*b*, 702*c*, 1008 can be configured to be at least partially customized to influence or enhance gait, stance, posture, propulsion, and agility, among other needs. For example, the plates 200, 400, 500, 702*a*, 702*b*, 702*c*, 1008 may be configured to alleviate pain and/or improve performance for users with medical issues or deformities. Still further, bending resistance BR and torsional resistance TR of the plates 200, 400, 500, 702*a*, 702*b*, 702*c*, 1008, which account for and relate to the moment of inertia MOI and elastic modulus values, may be increased and customized for particular applications.

It is contemplated that any of the plates 200, 400, 500, 702*a*, 702*b*, 702*c*, 1008 described in the present disclosure may include embedded functionality that is additional to the structural stiffness properties described above. For example, it is contemplated that the plates 200, 400, 500, 702*a*, 702*b*, 702*c*, 1008 may have or be modified to have electrically conductive materials, thermally conductive materials, electrically insulative materials, thermally insulated materials, optically transmissive materials, or fluidically transmissive materials. Additionally or alternatively, a device (not shown) may be embedded within any of the plates of this disclosure. In one instance, the device (not shown) may be a sensor, e.g., a transducer, an accelerometer, a geolocation sensor, a temperature sensor, a humidity sensor, or a moisture sensor. Further, the device (not shown) may be capable of providing haptic feedback to a user, such that a user can be notified to avoid prolonged periods of standing or sitting or immobility. Also, the device (not shown) may be an object or structural element, such as, e.g., an air-filled or fluid-filled bladder or pod. It is further contemplated that the device (not shown) may be capable of harvesting and storing energy caused by deformation of the plate and/or footwear during use, such as, e.g., piezoelectric transducers.

Figure 17:
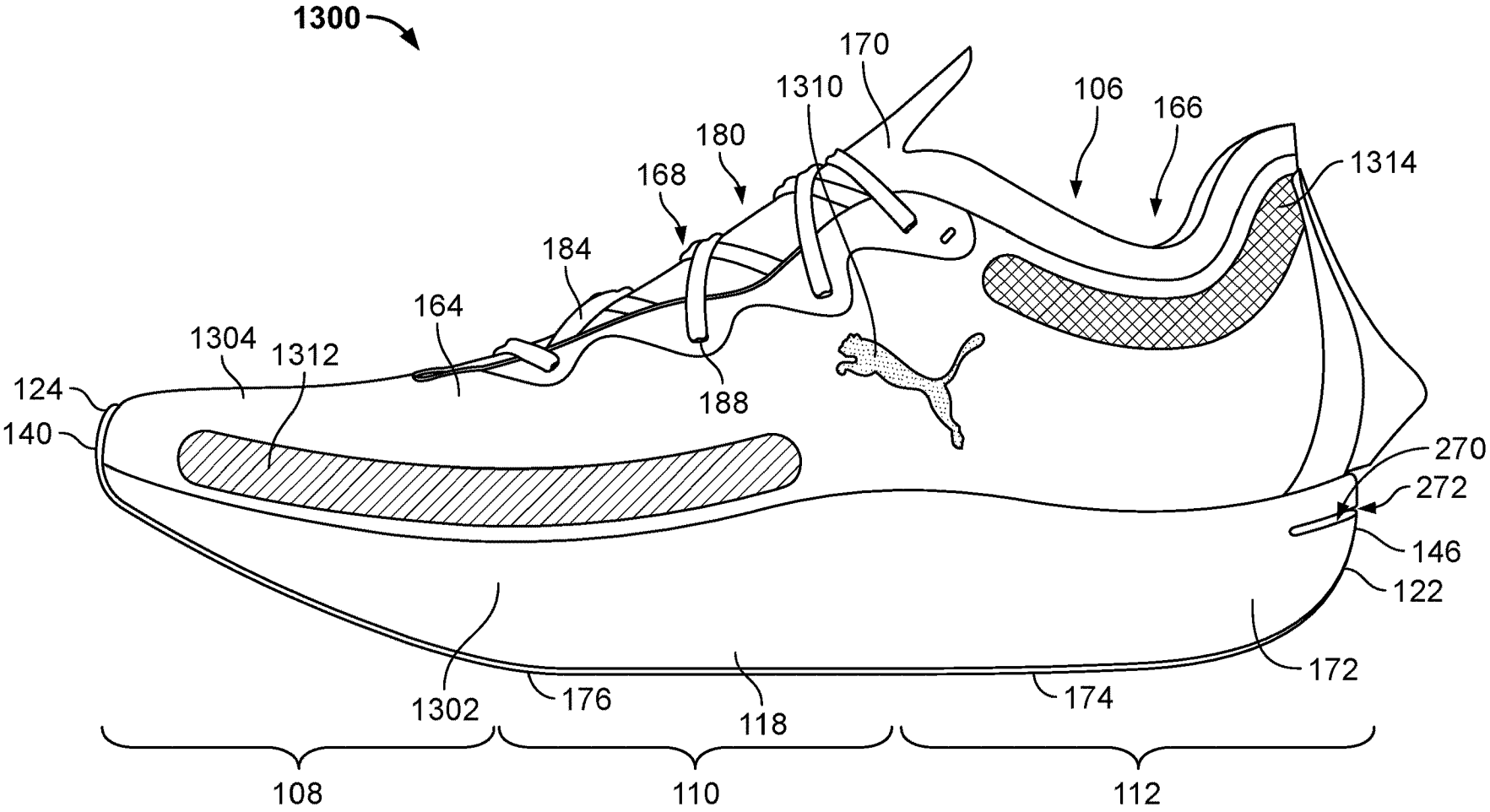
FIG. 17 is a side elevational view of another embodiment of an article of footwear.

Referring to FIG. 17, another embodiment of an article of footwear 1300 is provided. The article of footwear 1300 of FIG. 17 has similarities to the article of footwear 100; thus, like reference numbers are used to indicate like elements. As illustrated in FIG. 17, the article of footwear 1300 comprises a sole structure 1302 and an upper 1304. The article of footwear 1300 can also comprise the plate 200 within the cavity 270 and the slot 272. However, in some embodiments, the article of footwear 1300 may not comprise the cavity 270 and/or the slot 272. Further, in some embodiments, the article of footwear 1300 may be manufactured to include a plurality of markings thereon, including a first marking 1310 positioned adjacent the midfoot region 110 and the heel region 112 (adjacent the tightening system 180), a second marking 1312 positioned adjacent the forefoot region 108 and midfoot region 110, and a third marking 1314 positioned adjacent the heel region 112. In the illustrated embodiment, the first marking 1310 is depicted as a logo or emblem, although the first marking 1310 may be any symbol, code, cipher, indicia, or the like. The second and third markings 1312, 1314 are depicted as indicia comprising curved stripes or design features, which mirror the contours of the upper 1304. The first, second, and third markings 1310, 1312, 1314 are depicted as being provided on the upper 1304, although other configurations are possible. For example, one or more of the first, second, and third markings 1310, 1312, 1314 may be positioned on the sole structure 1302. In some embodiments, the upper 1304 may be provided with the first, second, and third markings 1310, 1312, 1314 through implementation of the manufacturing methods described above, such that the markings 1310, 1312, 1314 are integrally formed with the upper 1304.

Further, at least one of the markings 1310, 1312, 1314 may contain a code or identifier, such as, e.g., a machine-readable identifier. The code can be used to authenticate the article of footwear 1300, such that the code is associated with a serial number or unique ID, or a token or key, which can be scanned by, e.g., the user device, which may be a smartphone or special purpose scanning device, such as those employing near field communication (NFC) technologies, or the like. The code may correspond to encoding parameters stored in a remote host system, such as a digital platform, and the encoding parameters can include a manufacturing date, manufacturing location, identification of the manufacturer, serial number or unique ID, numbers associated with modifications or customized features, aspects of the article of footwear 1300, such as model and type, materials, numbers associated with the quantity of items produced, such as for limited edition products, among others. Further, the code may require the user device or scanning device to implement symmetric or asymmetric encoding algorithms or methods, such as, e.g., advanced Encryption Standard (AES), Rivest-Shamir-Adleman (RSA), Triple Date Encryption Standard (DES), Twofish, or any other suitable encryption method. In some instances, the code may be compatible with hashing functions or algorithms implemented by the user device or scanning device, such as, e.g., Secure Hash Algorithms (SHA) published by the National Institute of Standards and Technology (NIST), or equivalents. It is contemplated the user device or the scanning device must run particular operating systems or applications to implement such methods for reading the code, although in some instances the code may be pre-programmed to, upon detection by a sensor or camera, automatically initialize a browser to search a web address (e.g., a URL) for accessing the necessary software to read the code.

The code may resemble a barcode or the code may be a QR code, or a cipher containing unique symbols or unique combinations of symbols, or colors, or the like. As illustrated in FIG. 17, the second and third markings 1312, 1314 include indicia comprising stripes and design features which can be printed on or formed with the upper 1304 in accordance with the encoding algorithm that determines the appropriate identifying aspects of the indicia, such as the size, color, shape, and arrangement of the stripes and bars, to store and communicate information. In some embodiments, the markings 1310, 1312, 1314 may be formed with conductive ink, conductive fabric, or ferromagnetic elements comprising the code. For example, the markings 1310, 1312, 1314 may include conductive ink arranged to comprise electrical resistance values in discrete, predetermined locations, such that the combination of such values corresponds to a serial number or unique ID associated with the article of footwear 1300. In some instances, the upper 1304 is formed with embedded ferromagnetic elements or ferrimagnetic elements which are arranged to form magnetic zones having discrete, predetermined magnetic property values, e.g., magnetic flux density values, such that a magnetometer, e.g., a gaussmeter or teslameter, may be used to measure the magnetic property values that, in combination, correspond to the serial number or unique ID associated with the article of footwear 1300. When scanned, the code may enable access, via the user device, to the digital platform, or to a secured website or address or application that is hosted remotely having at least part of a cryptographic key or token, such as a private key, which corresponds to or unlocks a digital asset, such as an NFT, which includes a design model or the unique ID or serial number associated with the article of footwear 1300. In this way, the article of footwear 1300 may be authenticated by the user for assurance that the article of footwear 1300 is manufactured by a particular manufacturer or brand. Further, the code may provide authentication of the custom features of the article of footwear 1300. Additionally, as discussed above, the sole structure 1302 may include similar machine-readable identifiers, such as markings 1310, 1312, 1314, as illustrated in FIG. 17. In some embodiments, the plate 200, 400, 500, 702*a*, 702*b*, 702*c*, 1008 may include similar machine-readable identifiers, such as the markings 1310, 1312, 1314, thereon. In some embodiments, the markings 1310, 1312, 1314 may be visible through a portion of the sole structure, such as, e.g., through a transparent or translucent window (not shown) formed in the outsole or the midsole, to enable communication with a smartphone or scanner or the like. In some embodiments, the markings 1310, 1312, 1314 are capable of communication without being visible via wireless communication, e.g., NFC or Bluetooth®. Further, in some embodiments, the indicator 320 may be a machine-readable identifier as discussed above with respect to the markings 1310, 1312, 1314.

In some embodiments, the code of the article of footwear 1300 is readable by authorized third-parties for tracking purposes. For example, entities throughout the supply chain, such as shipping companies, may scan the code for tracking purposes. In some instances, the code may be used for inventory tracking purposes, such that wholesalers, retailers, and fitting professionals may scan the code to update an inventory management system. In some examples, the web address or digital platform may be capable of tracking and recording the identity, such as the device ID or product ID, of each entity that has obtained access. Further, the user may be given the ability to access the web address prior to receipt of the article of footwear 1300, such as via an email or secure notification through or on the digital platform. In this way, the code may assist the user in locating the article of footwear 1300 in the event of loss or theft, or to identify unauthorized access by, e.g., counterfeiters.

As discussed above, in some embodiments, the indicators 320 on the plates 200, 400, 500, 702*a*, 702*b*, 702*c*, 1008 may be similar to the markings 1310, 1312, 1314, discussed above. Therefore, the indicators 320 may be a machine-readable identifier that may be scanned by the user device or the scanning device, e.g., a phone, a scanner, a reader, etc. As discussed above, the user device or the scanning device can be web-enabled and may be connected to a digital platform. In some embodiments, the indicators 320 may be a machine-readable identifier that include various parameters/information. For example, the serial number, the material properties, performance properties, and/or the brand of the plate 200, 400, 500, 702*a*, 702*b*, 702*c*, 1008 may be included on the indicators 320. In some embodiments, the indicators 320 may be machine-readable identifiers that include the degradation or depletion of the plate 200, 400, 500, 702*a*, 702*b*, 702*c*, 1008. Thus, the indicators 320 may identify how degraded or depleted the plate 200, 400, 500, 702*a*, 702*b*, 702*c*, 1008 is and if a new plate 200, 400, 500, 702*a*, 702*b*, 702*c*, 1008 should be inserted into the article of footwear 100, 1000, 1100, 1200, 1300. Further, in some embodiments, the indicators 320 may be a machine-readable identifier that include the performance properties and/or material properties of the plate 200, 400, 500, 702*a*, 702*b*, 702*c*, 1008 for racing authorities or governing bodies to use in order to make sure that the plate 200, 400, 500, 702*a*, 702*b*, 702*c*, 1008 is not an unauthorized version of the plate 200, 400, 500, 702*a*, 702*b*, 702*c*, 1008. For example, authorized personnel for the Boston Marathon® may be able to scan the indicators 320 on the plates 200, 400, 500, 702*a*, 702*b*, 702*c*, 1008 to determine if the plate 200, 400, 500, 702*a*, 702*b*, 702*c*, 1008 is acceptable for the race/performance. Furthermore, in some embodiments, the indicators 320 may be a machine-readable identifier that has a token or link to an NFT. Therefore, the indicators 320 may allow a user to unlock or acquire an NFT, which can authenticate the plate 200, 400, 500, 702*a*, 702*b*, 702*c*, 1008. Furthermore, in some embodiments, the user can authenticate the plate 200, 400, 500, 702*a*, 702*b*, 702*c*, 1008 in another way, e.g., taking the user to a web address (URL) where the user can register the plate 200, 400, 500, 702*a*, 702*b*, 702*c*, 1008. Still further, in some embodiments, the indicators 320 may be scanned by a third party, such as a racing authority or some entity in the supply chain (e.g., a retailer or distributor). Further, in some embodiments, the indicators 320 allow the user to confirm that the plate 200, 400, 500, 702*a*, 702*b*, 702*c*, 1008 is an authentic plate, i.e., not a knock off. As noted herein, the plate 200, 400, 500, 702*a*, 702*b*, 702*c*, 1008 can comprise various markings 1310, 1312, 1314 thereon that are machine-readable identifiers, similar as discussed above with respect to the indicators 320.

It is further contemplated that the plate 200, 400, 500, 702*a*, 702*b*, 702*c*, 1008 includes a power storage unit 1320 (see FIG. 16), such as a battery, capacitor, supercapacitor, or the like. Accordingly, the plate 200, 400, 500, 702*a*, 702*b*, 702*c*, 1008 can be removed for recharging the power storage unit 1320 or for replacing the power storage unit 1320. In addition, the plate 200, 400, 500, 702*a*, 702*b*, 702*c*, 1008 can be replaced with another plate that includes a charged power storage unit 1320 while the removed plate is charged or serviced. The power storage unit 1320 may be used to provide power to a circuit (not shown) in connection with various electronic features, such as, e.g., lighting, displays, control modules, sensors, transmitters or receivers or transceivers, or combinations thereof, or any other electronic feature provided on the article of footwear 100.

Figure 18:
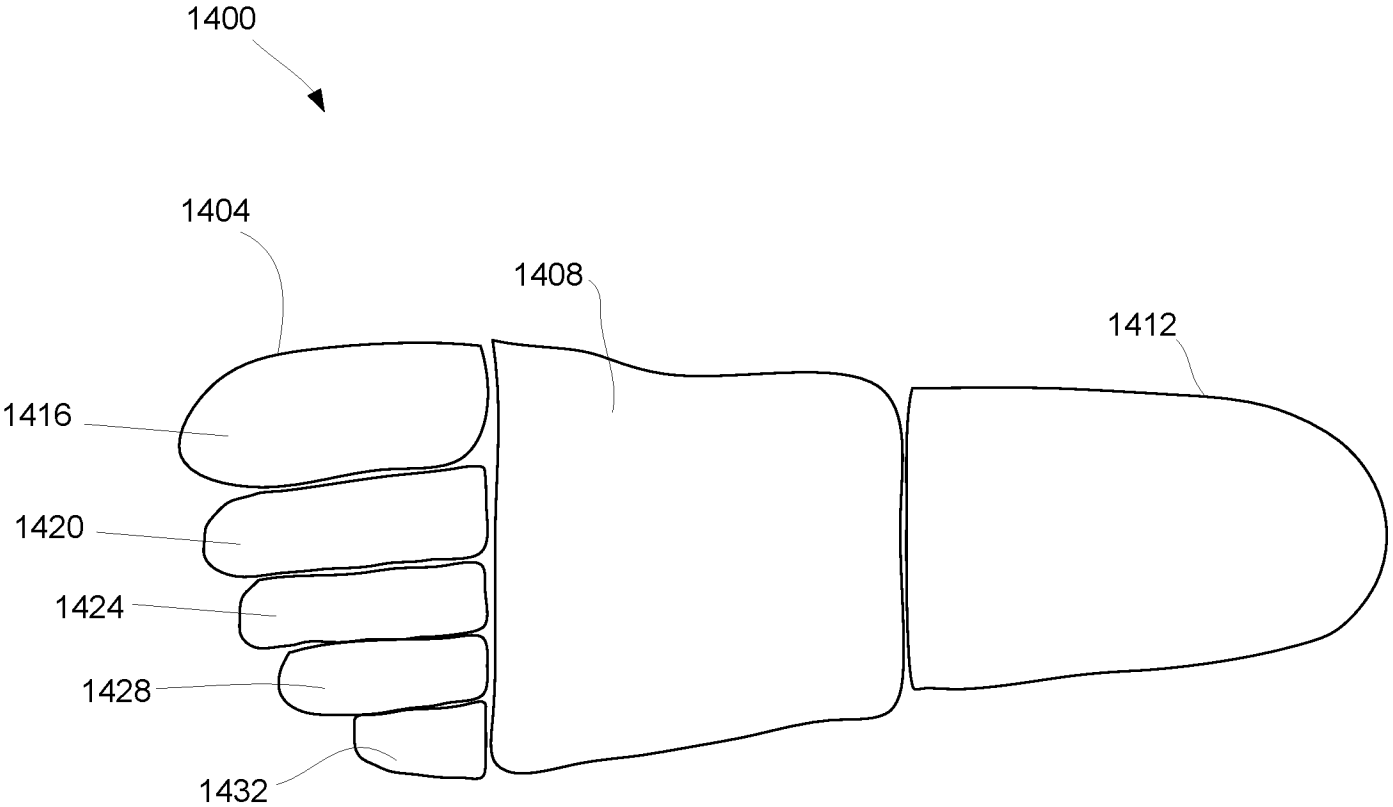
FIG. 18 is a schematic representation of another embodiment of a plate for use with the articles of footwear of the present disclosure.

In some embodiments, the plate 200, 400, 500, 702*a*, 702*b*, 702*c*, 1008 can be segmented into discrete subportions that correspond with areas of a user's foot. With reference to FIG. 18, an embodiment of a plate 1400 is laterally segmented into a forefoot segment 1404, an arch or midfoot segment 1408, and a heel segment 1412. It is further contemplated that the plate 1400 can be longitudinally segmented into portions that correspond with the medial side 118 and the lateral side 116, or segmented along the lines 144, 150, and 120 of FIG. 3. Additionally or alternatively, the forefoot segment 1404 of the plate 1400 can be provided as a plurality of longitudinal segments 1416, 1420, 1424, 1428, 1432 that correspond with each respective phalange 130 of the user's foot. It is contemplated that the plate 1400 can vary in thickness, material composition, stiffness, size, shape, and other characteristics among the segments. Accordingly, the article of footwear 100 may include multiple slots 272, 910 (see FIGS. 1 and 13) that are sized, shaped, and positioned to permit insertion and removal of each segment or portion of the plate 1400. In some instances, users may selectively insert all of the segments, some segments, or none of the segments of the plate 1400 for use with the footwear 100. For instance, users having a need for increased support in the midfoot region 110 may only desire to insert the midfoot segment 1408 of the plate 1400. Additionally or alternatively, the user may realize a need for support along the hallux near the ball of the foot 132 (see FIG. 3) and, thus, may install the longitudinal segment 1416 in the forefoot region 108 of the article of footwear 100. In some embodiments, the plate 1400 can be folded to increase stiffness or support in certain areas. For example, the longitudinal segments 1416 and 1420 may be connected to one another along a living hinge (not shown) or by fasteners, fibers, and/or stitching, so that the user can selectively fold one segment over the other and insert the combination into the article of footwear 100 to effectively increase the stiffness or support provided in select areas of the user's foot. In some embodiments, the plate 1400 is provided with each segment being entirely separate and distinct from one another. In some embodiments, at least some of the segments of the plate 1400 can be coupled to one another by frangible portions (not shown) that allow the user to selectively keep segments attached or to break segments apart, as desired.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

I claim:

1. An article of footwear, comprising:

an upper attached to a sole structure, wherein the sole structure includes a midsole that is positioned between an insole and an outsole; and a plate that is removably received within a cavity formed within the midsole, wherein the plate is surrounded by the midsole within the cavity, wherein a slot is formed in a lateral side or a medial side of an exterior of the midsole and is in communication with the cavity, wherein the plate is configured to be inserted into the cavity of sole structure through the slot, and wherein the plate includes a reinforcing member comprising carbon fiber, wherein the cavity defines a cavity width and the plate defines a plate width, and wherein the cavity width in a heel region of the cavity is smaller than the plate width in a forefoot region of the plate.

2. The article of footwear of claim 1, wherein the slot is positioned in the heel region of the article of footwear.

3. The article of footwear of claim 1, wherein the slot is positioned in a forefoot region of the article of footwear.

4. The article of footwear of claim 1, wherein the cavity comprises a cavity wall, and wherein a plurality of fingers extend from the cavity wall and into the cavity.

5. The article of footwear of claim 4, wherein the plurality of fingers are configured to engage a portion of the plate disposed within the cavity.

6. A system for an article of footwear, comprising:

an upper attached to a sole structure, wherein a cavity is formed within the sole structure and positioned between an insole and an outsole of the article of footwear;

a first plate having a first indicator and a first stiffness value, wherein the first indicator is configured to indicate the first stiffness value; and a second plate having a second indicator and a second stiffness value, wherein the second indicator is configured to indicate the second stiffness value, wherein the first plate and the second plate are configured to be interchangeably received within the cavity of the article of footwear, wherein each of the first plate and the second plate is configured to be inserted by sliding an anterior end into the cavity through a slot that is formed in an exterior of a heel end of the sole structure, wherein the cavity defines a cavity width, and the first plate and the second plate each define a plate width, and wherein the cavity width in a heel region of the cavity is smaller than the plate width in a forefoot region of each of the first plate and the second plate.

7. The system for the article of footwear of claim 6, wherein the first indicator or the second indicator indicates a depleted condition.

8. The system for the article of footwear of claim 6, wherein the article of footwear comprises one or more markings that are machine-readable identifiers.

9. The system for the article of footwear of claim 8, wherein the one or more markings connect a user to a digital platform when scanned by a user device.

10. The system for the article of footwear of claim 6, wherein the first indicator or the second indicator is a machine-readable identifier.

11. The system for the article of footwear of claim 10, wherein the first indicator or the second indicator connect a user to a digital platform when scanned by a user device.

12. A method of using a modular plate system, comprising:

providing an article of footwear having an upper attached to a sole structure, wherein a cavity is formed within the sole structure of the article of footwear and positioned between an insole and an outsole of the article of footwear, and wherein a slot is formed in a lateral side or medial side of an exterior of a midsole and in communication with the cavity;

providing a first plate having a first indicator that indicates a stiffness of the first plate;

providing a second plate having a second indicator that indicates a stiffness of the second plate;

positioning the first plate within the cavity of the article of footwear by sliding an anterior end or a posterior end through the slot;

cycling the first plate until the first indicator indicates a depleted condition of the stiffness of the first plate; and replacing the first plate with the second plate within the cavity of the article of footwear;

wherein the cavity defines a cavity width, and the first plate and the second plate each define a plate width, and wherein the cavity width in a heel region of the cavity is smaller than the plate width in a forefoot region of each of the first plate and the second plate.

13. The method of using the modular plate system of claim 12, the method of using the modular plate system further comprising:

cycling the second plate until the second indicator indicates a depleted condition of the stiffness of the second plate; and replacing the second plate with a third plate within the cavity of the article of footwear.

14. The method of using the modular plate system of claim 12, wherein the first indicator or the second indicator is a machine-readable identifier.

* * * * *